US012654901B2

(12) United States Patent
Valencia

(10) Patent No.: US 12,654,901 B2
(45) Date of Patent: Jun. 16, 2026

(54) STACKABLE CARTON, BLANK AND METHOD OF FORMING

(71) Applicant: WestRock Shared Services, LLC, Atlanta, GA (US)

(72) Inventor: John Valencia, Johns Creek, GA (US)

(73) Assignee: WestRock Shared Services, LLC, Atlanta, GA (US)

( * ) Notice: Subject to any disclaimer, the term of this patent is extended or adjusted under 35 U.S.C. 154(b) by 454 days.

(21) Appl. No.: 18/026,876

(22) PCT Filed: Sep. 17, 2021

(86) PCT No.: PCT/US2021/050910
§ 371 (c)(1),
(2) Date: Mar. 17, 2023

(87) PCT Pub. No.: WO2022/061138
PCT Pub. Date: Mar. 24, 2022

(65) Prior Publication Data

US 2023/0331428 A1 Oct. 19, 2023

Related U.S. Application Data

(60) Provisional application No. 63/080,356, filed on Sep. 18, 2020.

(51) Int. Cl.
*B65D 5/46* (2006.01)
*B65D 5/00* (2006.01)
*B65D 85/34* (2006.01)

(52) U.S. Cl.
CPC ..... *B65D 5/46112* (2013.01); *B65D 5/001* (2013.01); *B65D 85/34* (2013.01)

(58) Field of Classification Search
CPC .... B65D 5/46112; B65D 5/001; B65D 85/34; B65D 5/061; B65D 5/4295; B65D 5/46144; B65D 5/2057; B65D 5/10
USPC .... 229/117.12, 117.15, 117.14, 117.22, 140, 229/117.25, 149, 915; 206/509
See application file for complete search history.

(56) References Cited

U.S. PATENT DOCUMENTS

| | | | | |
|---|---|---|---|---|
| 5,520,284 A * | 5/1996 | Gray | B65D 5/001 | 229/149 |
| 9,533,790 B2 * | 1/2017 | Williams | B65D 5/001 | |
| 2001/0004088 A1 * | 6/2001 | Lau | B65D 5/2033 | 229/117.22 |
| 2004/0031842 A1 * | 2/2004 | Westerman | B65D 81/38 | 229/117.06 |

(Continued)

FOREIGN PATENT DOCUMENTS

KR 100 408 200 B1 12/2003

OTHER PUBLICATIONS

International Search Report issued in PCT/US2021/050910, mailed Jan. 14, 2022.

*Primary Examiner* — Christopher R Demeree
(74) *Attorney, Agent, or Firm* — Neil G. Cohen; Rohini K. Garg

(57) ABSTRACT

Carton (100) includes a bottom wall (104), a plurality of side walls (140, 142, 144, 146) connected to the bottom wall, and a top wall (106) releasably coupled to one of the side walls. The carton also includes a handle (112) formed by at least a portion of the top wall. The carton further includes a planar surface (114) at least partially formed by the handle (112) and the top wall (106).

11 Claims, 15 Drawing Sheets

(56) References Cited

U.S. PATENT DOCUMENTS

| | | | | |
|---|---|---|---|---|
| 2005/0023331 | A1* | 2/2005 | Hirschey ..... | B65D 5/48048<br>229/120.32 |
| 2014/0262911 | A1* | 9/2014 | Kooc ..... | B65D 5/46104<br>206/509 |
| 2019/0016500 | A1 | 1/2019 | Oliveira | |

* cited by examiner

STACKABLE CARTON, BLANK AND METHOD OF FORMING

CROSS REFERENCE TO RELATED APPLICATIONS

This application is a U.S. 371 National Phase Patent Application of International PCT Patent Application No. PCT/US2021/050910, filed on Sep. 17, 2021, which application claims the benefit of priority to U.S. Provisional Patent Application No. 63/080,356, filed on Sep. 18, 2020. The entire contents of these applications are incorporated herein by reference in their entirety.

FIELD

The present disclosure relates generally to product packaging and, more particularly, to cartons for packaging product, blanks for forming cartons and methods of forming cartons from blanks. More particularly, though not exclusively, the present disclosure relates to cartons that include an integral handle and that are configured to be stacked.

BACKGROUND

In the field of packaging and, more particularly, in the field of fresh food packaging, a product is often provided with an exterior container. For example, the product, such as fresh fruit and vegetables, may be packaged in a carton C (FIG. 1) or a bag B (FIG. 2). Such containers are desirable for shipping and distribution, for product protection and for display of product identification or promotional information.

It is also desirable that the end consumer be able to use the container as a product carrier when the product is sold. For example, many product containers include a handle H (FIGS. 1 and 2) that provides the consumer the ability to carry the product. Usually, the handle H is located at the top of the container and extends outwardly from the top of the container.

It is also desirable for product containers to be stackable for shipping (e.g., on a pallet), storage (e.g., in a warehouse) or display (e.g., on a store shelf). However, typical containers may make it difficult or impossible to stack the containers due to the lack of structural integrity of the container (e.g., bag B) or due to the configuration of the handle H of the container (e.g., carton C).

For shipping, product protection and consumer carrying considerations, it is also desirable to ensure that such containers have suitable strength for holding and transporting the product. For cost and environmental considerations, it is also desirable that such containers be formed from as little material as possible and cause as little wastage of the materials as possible. For cost and process considerations, it is also desirable for such containers to be formed through as simple a set of operations as possible to aid in automation of the container formation and loading process.

Accordingly, those skilled in the art continue with research and development efforts in the field of product packaging.

SUMMARY

Disclosed are cartons for packaging product, blanks for forming the disclosed cartons, methods of forming the disclosed cartons from the disclosed blanks and methods of packaging product using the disclosed cartons. The following is a non-exhaustive list of examples, which may or may not be claimed, of the subject matter according to the present disclosure.

In an example, the disclosed carton includes a bottom wall, a plurality of side walls connected to the bottom wall, and a top wall releasably coupled to one of the side walls. The carton also includes a handle formed by at least a portion of the top wall. The carton further includes a planar surface at least partially formed by the handle and the top wall.

In an example, the disclosed carton includes a plurality of panels that form an internal volume, a handle and a planar surface of the carton. The plurality of panels includes a first side panel, a second side panel foldably connected to the first side panel, a third side panel foldably connected to the second side panel, and a fourth side panel foldably connected to the third side panel. The plurality of panels also includes a first handle panel foldably connected to the first side panel and releasably coupled to the second side panel and a fourth side panel. The plurality of panels additionally includes a second handle panel foldably connected to the third side panel and releasably coupled to the second side panel and a fourth side panel. The first handle panel overlaps at least a portion of the second handle panel such that the first handle panel and the second handle panel form the handle and at least a portion of the planar surface.

In an example, the disclosed blank includes a first side panel, a second side panel foldably connected to the first side panel, a third side panel foldably connected to the second side panel and a fourth side panel foldably connected to the third side panel. The blank also includes a first handle panel foldably connected to the first side panel and a second handle panel foldably connected to the third side panel. The blank further includes a first portion of a locking mechanism on each one of the first handle panel and the second handle panel and a second portion of the locking mechanism on each one of the second side panel and the fourth side panel. When the carton is formed from the blank, the first portion of the locking mechanism and the second portion of the locking mechanism cooperate to couple the first handle panel and the second handle panel to the second side panel and the fourth side panel. When the carton is formed from the blank, the first handle panel and the second handle panel form a handle and a planar surface of the carton.

In an example, the disclosed method includes steps of: (1) providing a blank including a plurality of panels; and (2) manipulating the blank such that the plurality of panels form a bottom wall, a top wall, a plurality of side walls and a handle of the carton. The top wall is releasably coupled to an opposed pair of the plurality of side walls. The handle is formed by at least a portion of the top wall. The handle and the top wall form a planar surface of the carton.

In an example, the disclosed method includes steps of: (1) erecting a carton such that a side wall is uncoupled from a top wall; (2) loading product into an internal volume of the carton; and (3) further erecting the carton such that the side wall is coupled to the top wall.

Other examples of the disclosed cartons, blanks and methods will become apparent from the following detailed description, the accompanying drawings, and the appended claims.

DETAILED DESCRIPTION

Figure 1:
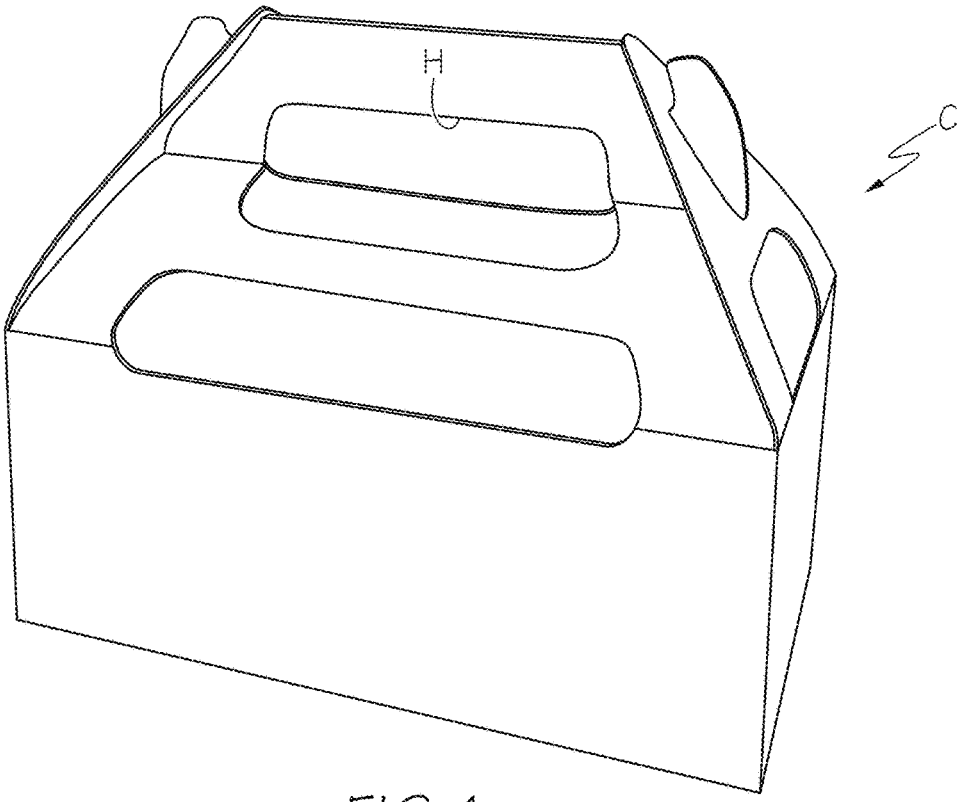
FIG. 1 is a schematic, perspective view of an example of a conventional product packaging container in the form of a carton.

The following detailed description refers to the accompanying drawings, which illustrate specific examples of the disclosed carton and blank described by the present disclosure. It will be understood that the disclosed examples are merely exemplary embodiments of the way in which certain aspects of the invention can be implemented and do not represent an exhaustive list of all of the ways the invention may be embodied. Other examples having different structures and operations do not depart from the scope of the present disclosure. Like reference numerals may refer to the same feature, element, or component in the different drawings. The figures are not necessarily to scale and some features may be exaggerated or minimized to show details of particular components. Throughout the present disclosure, any one of a plurality of items may be referred to individually as the item and a plurality of items may be referred to collectively as the items. Moreover, as used herein, a feature, element, component or step preceded with the word "a" or "an" should be understood as not excluding a plurality of features, elements, components or steps, unless such exclusion is explicitly recited.

Illustrative, non-exhaustive examples, which may be, but are not necessarily, claimed, of the subject matter according the present disclosure are provided below. Reference herein to "example" means that one or more feature, structure, element, component, characteristic, and/or operational step described in connection with the example is included in at least one aspect, embodiment, and/or implementation of the subject matter according to the present disclosure. Thus, the phrases "an example," "another example," "one or more examples," and similar language throughout the present disclosure may, but do not necessarily, refer to the same example. Further, the subject matter characterizing any one example may, but does not necessarily, include the subject matter characterizing any other example. Moreover, the subject matter characterizing any one example may be, but is not necessarily, combined with the subject matter characterizing any other example.

Referring to FIGS. 3-14, by way of examples, the present disclosure is directed to a carton 100 for packaging product. The carton 100 facilitates packaging, shipping and displaying of the product. In other words, the carton 100 provides, or serves as, an exterior packaging container for the product. The carton 100 also provides, or serves, as a carrier for the product, for example, after purchase by the consumer. The carton 100 further provides, or serves as, a support structure for stacking one carton 100 on top of another carton 100.

The carton 100 may be made from any suitable packaging material. Examples of suitable packaging material include paperboard, corrugated board, cardboard, plastic, combinations thereof and any other suitable material known to those skilled in the art and guided by the teachings provided herein.

The product may be any one of various types of primary product packaged by the carton 100. In one or more examples, the product is fresh food, such as fresh fruit or fresh vegetables. The carton 100 may be suitably sized and shaped to accommodate any reasonable number of products. Thus, throughout the present disclosure, the term "product" refers to one or more products.

Figure 3:
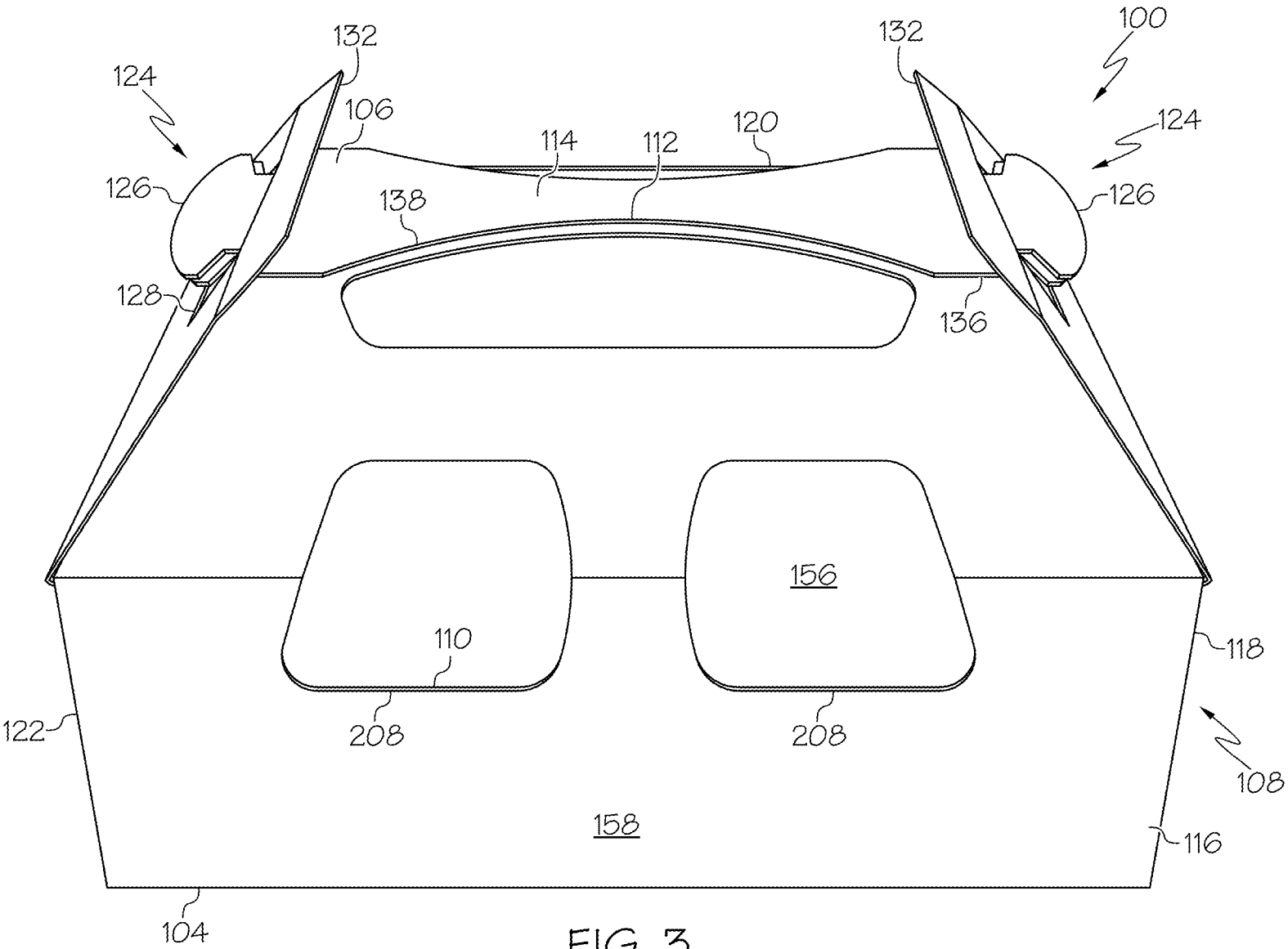
FIG. 3 is a schematic, perspective side view of an example of a carton for packaging product.
Figure 4:
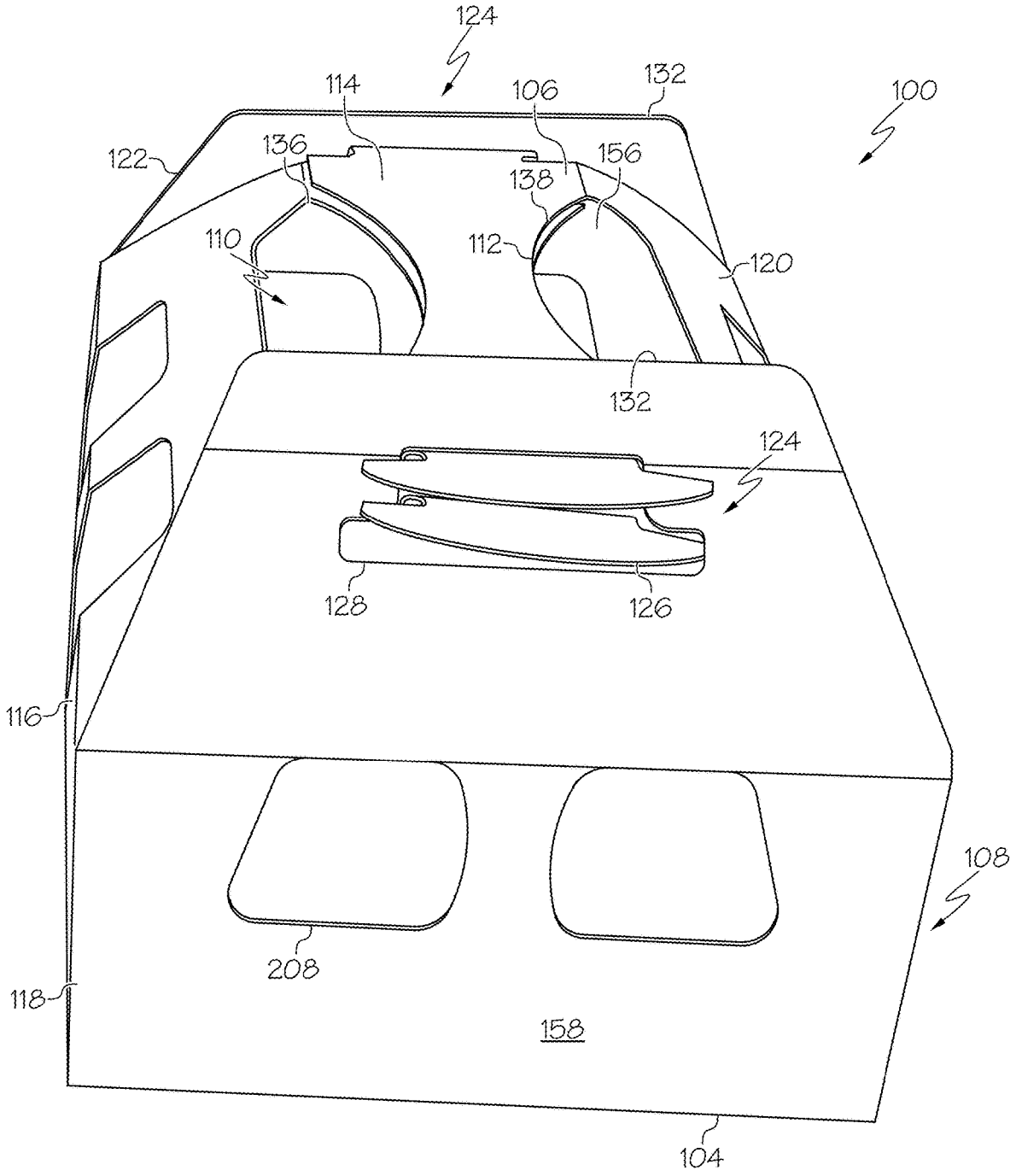
FIG. 4 is a schematic, perspective end view of the example of the carton shown in FIG. 3.

Referring to FIGS. 3 and 4, in one or more examples, the carton 100 includes a bottom wall 104, a plurality of side walls 104 and a top wall 106. The bottom wall 104, the top wall 106 and the side walls 108 form an internal volume 110 of the carton 100. The bottom wall 104, the top wall 106 and the plurality of side walls 108 enclose the product for shipping and display.

Figure 2:
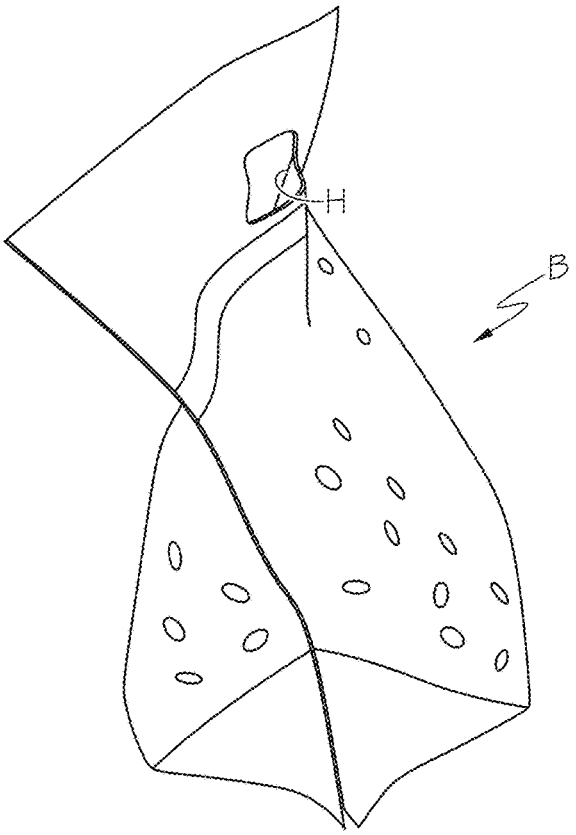
FIG. 2 is a schematic, perspective view of another example of a conventional product packaging container in the form of a bag.

In the examples illustrated in FIGS. 1-3, the carton 100 includes four side walls 108. For example, the carton 100 includes a first side wall 116 (e.g., a front wall), a second side wall 118 (e.g., a right end wall), connected to the first side wall 116, a third side wall 120 (e.g., a rear wall), connected to the second side wall 118 opposite the first side wall 116, and a fourth side wall 122 (e.g., a left end wall), connected to the third side wall 120 and the first side wall 116 opposite the second side wall 118. In other examples, the carton 100 may include less than four or more than four side walls.

In one or more examples, the plurality of side walls 108 are connected to the bottom wall 104. In one or more examples, each one of first side wall 116, the second side wall 118, the third side wall 120 and the fourth side wall 122 is connected to the bottom wall 104. The top wall 106 is opposite the bottom wall 104. In one or more examples, the top wall 106 is approximately parallel to the bottom wall 104.

The top wall 106 is releasably coupled to (e.g., detachable from) one of the side walls 108. In one or more examples, the top wall 106 is releasably coupled to more than one of the side walls 108. In one or more examples, the top wall 106 is releasably coupled to a first opposed pair of the side walls 108 (e.g., the second side wall 118 and the fourth side wall 122). In one or more examples, top wall 106 is connected (e.g., non-detachably connected) to a second opposed pair of the side walls 108 (e.g., the first side wall 116 and the third side wall 120). With the top wall 106 coupled to the first opposed pair of the side walls 108, the top wall 106 is configured to hold the carton 100 in a constructed (e.g., erected) configuration and to keep the carton 100 closed around the product.

The carton 100 also includes a handle 112. The handle 112 facilitates carrying the carton 100. The handle 112 is integral to the top wall 106. For example, the handle 112 is formed by at least a portion of the top wall 106. Alternatively, at least a portion of the top wall 106 is formed by the handle 112.

The carton 100 further includes a planar surface 114. The planar surface 114 is at least partially formed by the handle 112 and the top wall 106. For example, the handle 112 and the top wall 106 are approximately parallel to the bottom wall 104. As an example, when the handle 112 forms the top wall 106, the handle 112 is parallel to the bottom wall 104. As another example, when the handle 112 is formed by a portion of the top wall 106, the handle 112 and the top wall 106 are coplanar and are parallel to the bottom wall 104.

In one or more examples, a portion of an end 132 of at least one of the first opposed pair of side walls 108 (e.g., the second side wall 118 and/or the fourth side wall 122) extends beyond the top wall 106 and forms a portion of the planar surface 114 of the carton 100. In one or more examples, a portion of the end 132 of each one of the first opposed pair of side walls 108 (e.g., the second side wall 118 and the fourth side wall 122) extends beyond the top wall 106 and forms a portion of the planar surface 114 of the carton 100.

Figure 5:
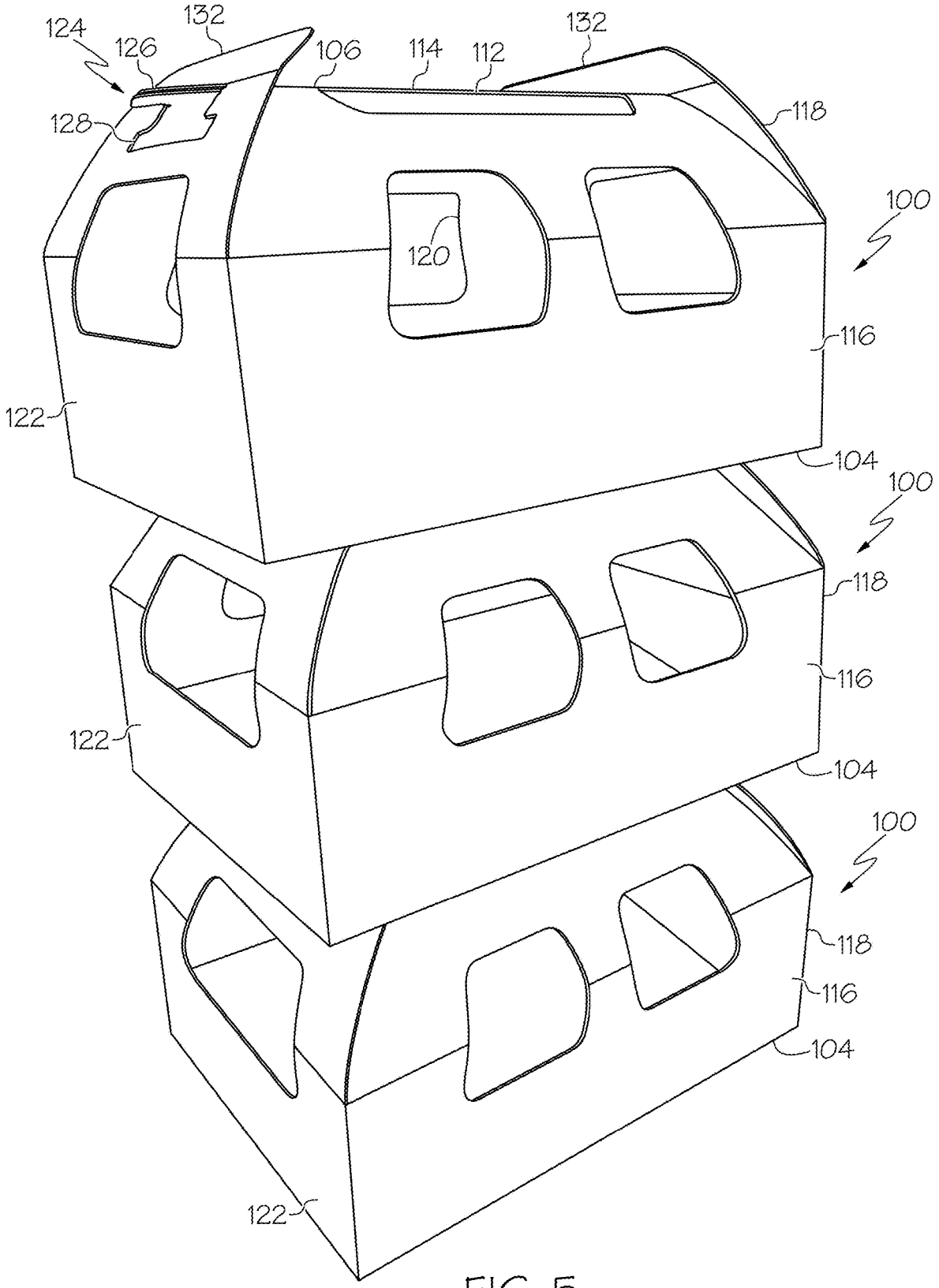
FIG. 5 is a schematic, perspective side view of an example of a plurality of the cartons shown in a stacked arrangement.
Figure 6:
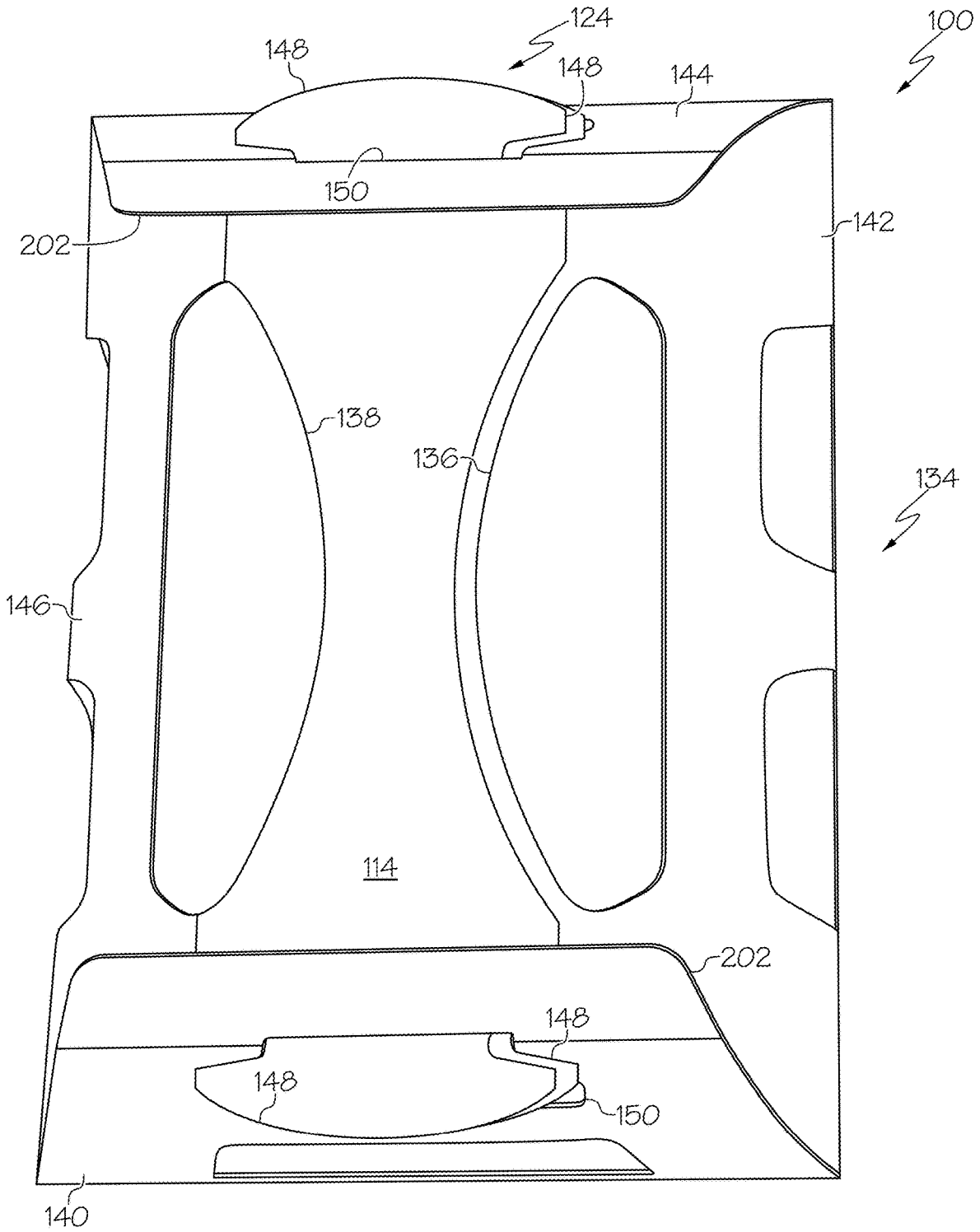
FIG. 6 is a schematic, perspective top view of an example of the carton.
Figure 7:
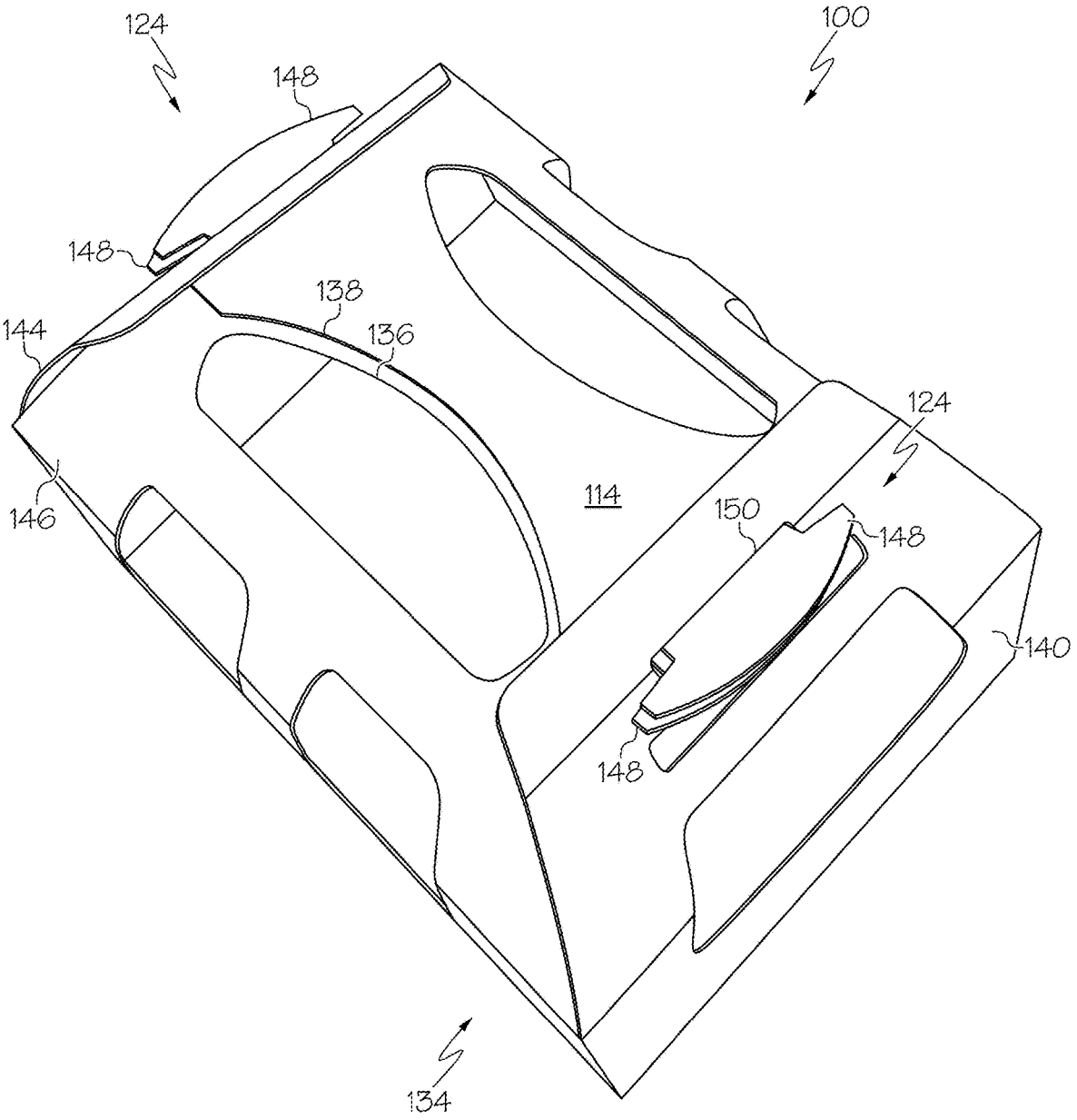
FIG. 7 is a schematic, perspective view of the example of the carton shown in FIG. 6.
Figure 8:
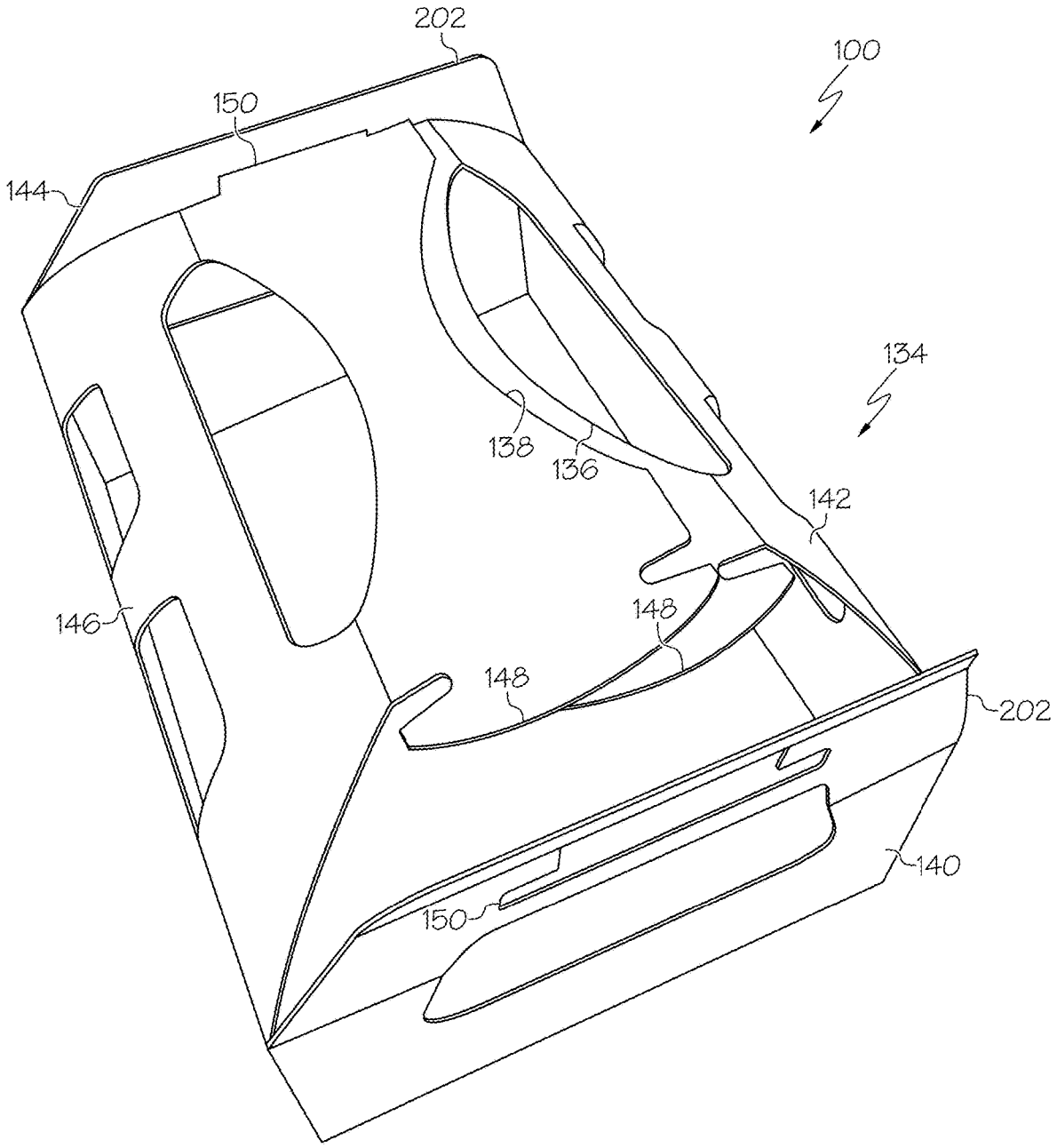
FIG. 8 is a schematic, perspective view of the example of the carton shown in FIG. 6, in which the carton is depicted with an end panel detached from a pair of top panels.
Figure 9:
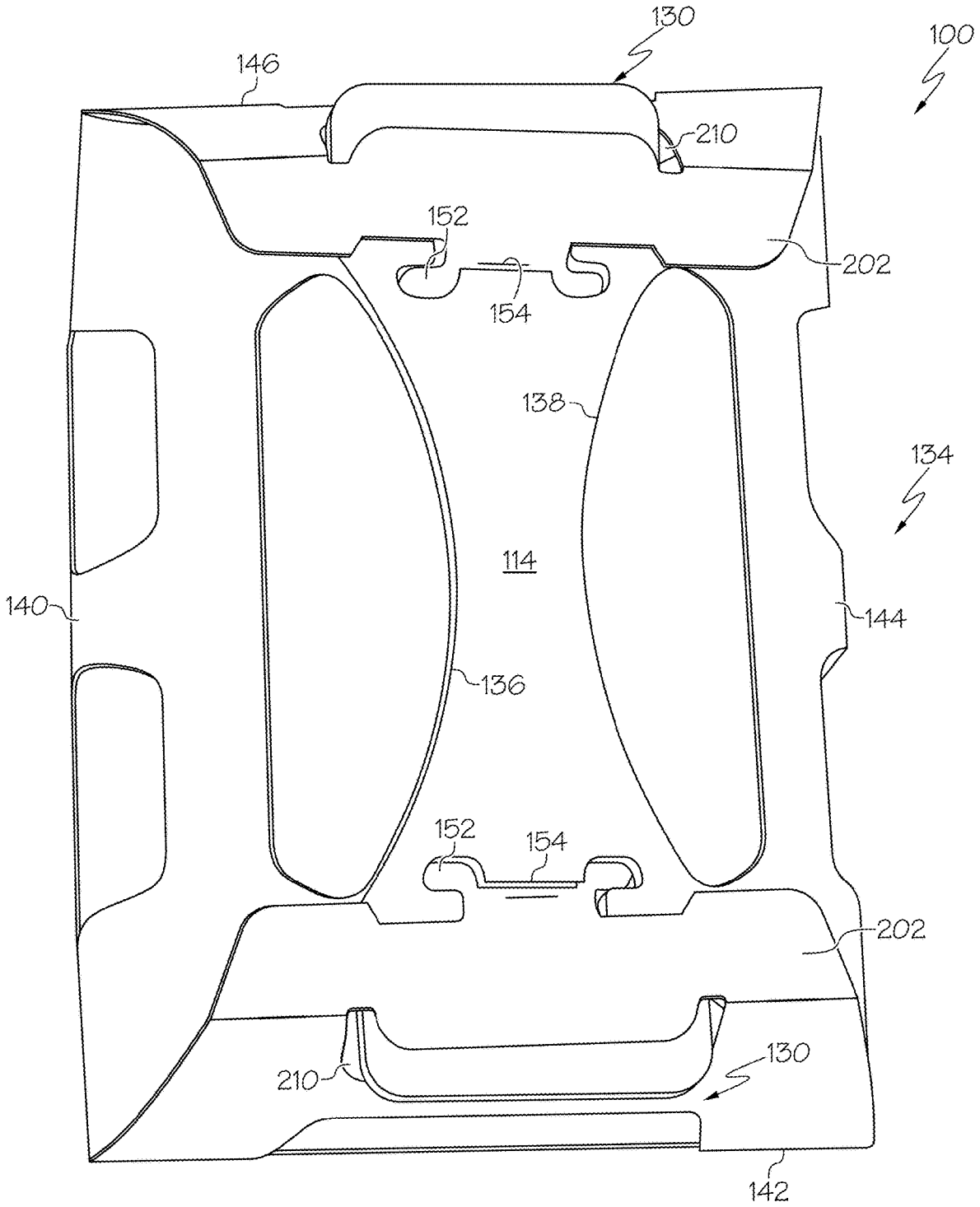
FIG. 9 is a schematic, perspective top view of another example of the carton.
Figure 10:
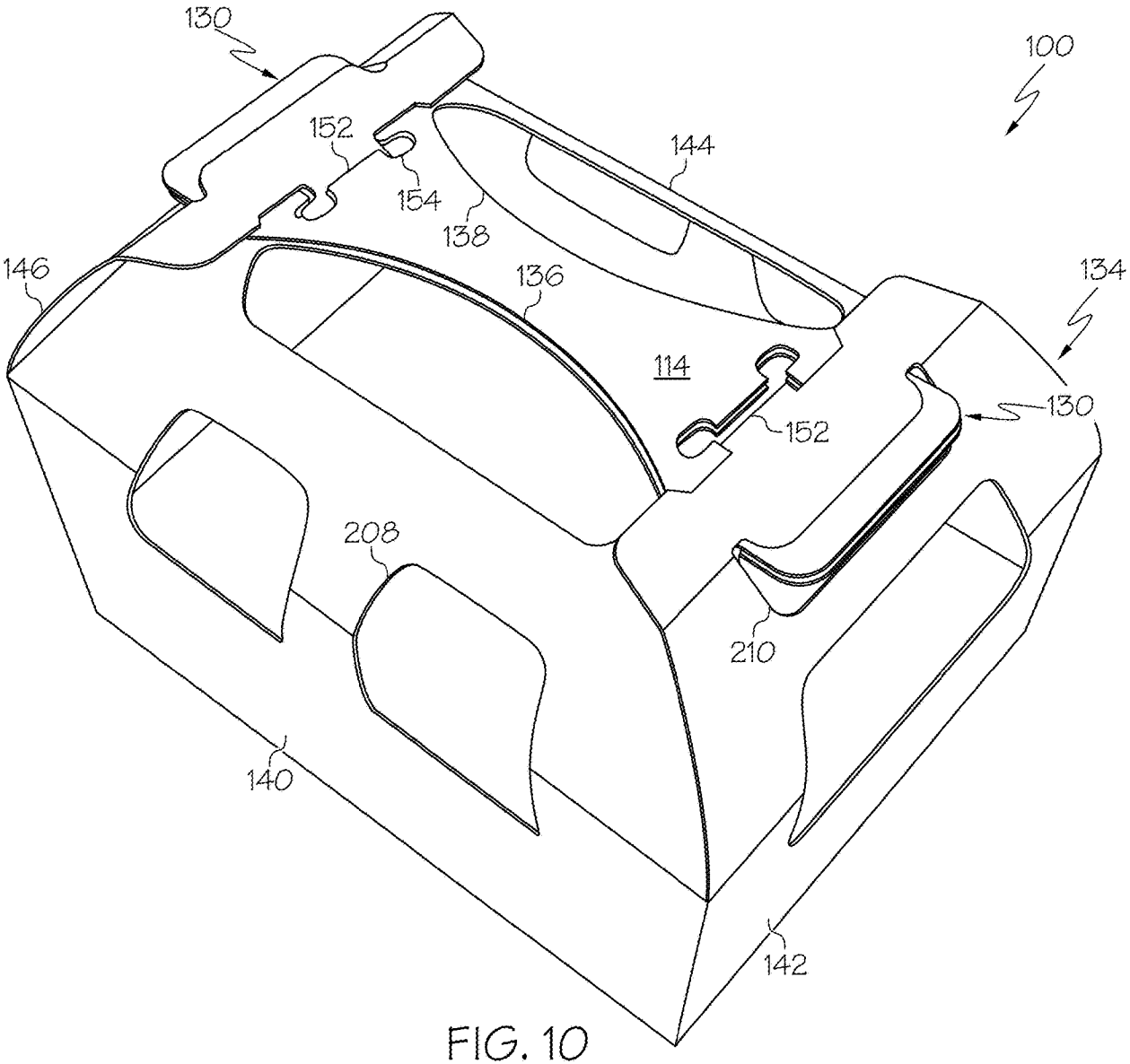
FIG. 10 is a schematic, perspective view of the example of the carton shown in FIG. 9.
Figure 11:
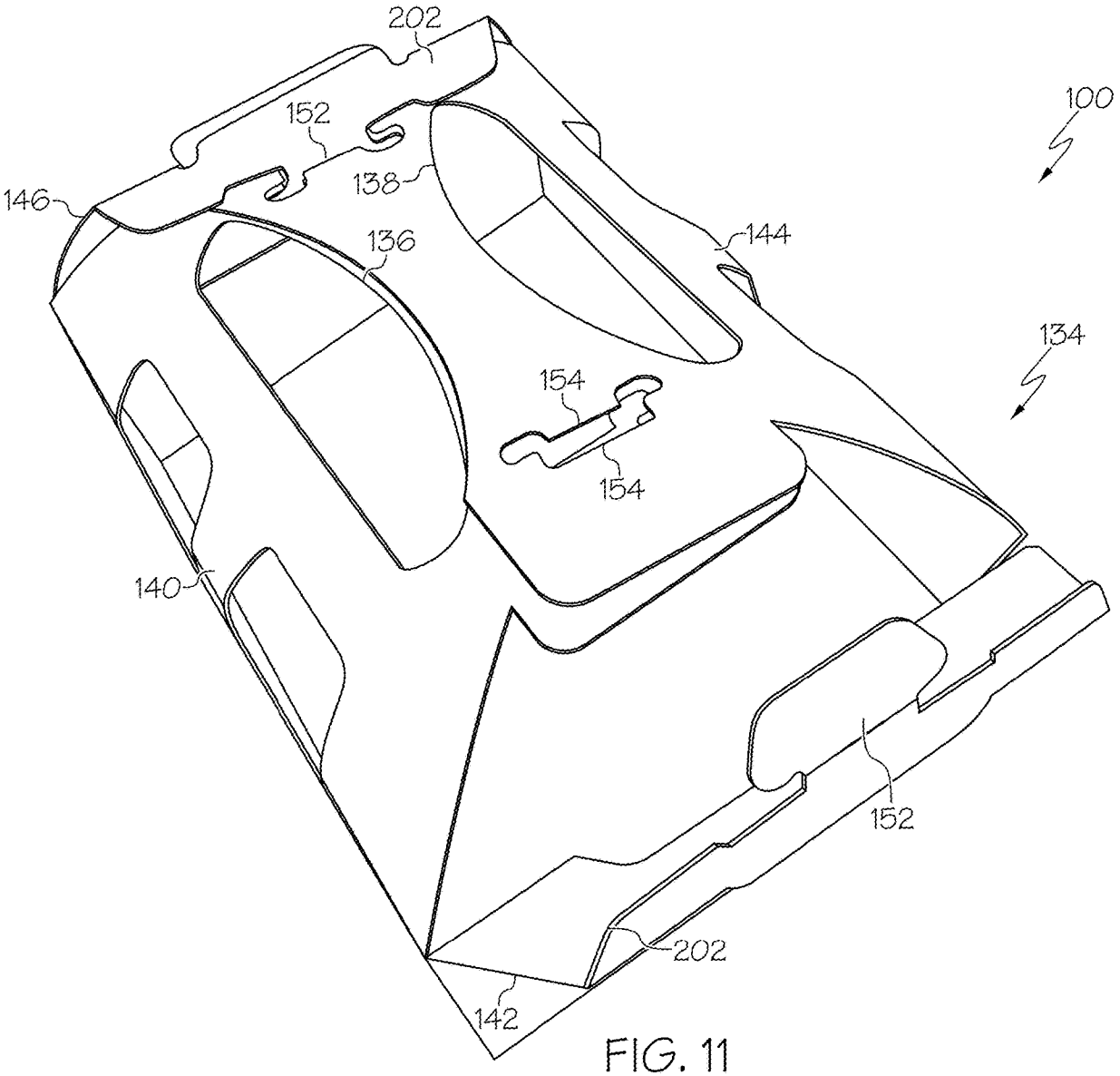
FIG. 11 is a schematic, perspective view of the example of the carton shown in FIG. 9, in which the carton is depicted with an end panel detached from a pair of top panels.

Referring to FIG. 5, the carton 100 is self-supporting and facilitates stacking, such as when being shipped, stored or displayed. The top wall 106 and the handle 112 are supported by the plurality of side walls 108 in an approximately horizontal and planar orientation. As such, the planar surface 114, formed by the handle 112 and the top wall 106, enable the carton 100 to be stacked in a vertical arrangement on top of another carton 100. For example, a plurality of cartons 100 are shown in FIG. 5 in which each carton 100 is stacked on another carton 100 such that the bottom wall 104 of an above carton 100 is in substantially flush contact with (e.g., is substantially coplanar with) the handle 112 and the top wall 106 of a below carton 100. The intercoupling of the top wall 106 and the first opposed pair of side walls 108 provides structural integrity to the carton 100 when the plurality of cartons 100 is stacked.

Referring again to FIGS. 3 and 4, in one or more examples, the carton 100 includes a locking mechanism 124. The locking mechanism 124 couples the top wall 106 and one of the side walls 108 together. For example, the locking mechanism 124 couples the top wall 106 to each one of the first opposed pair of side walls 108 (e.g., the second side wall 118 and the fourth side wall 122). As an example, the carton 100 includes an opposed pair of locking mechanisms 124. Each one of the pair of locking mechanisms 124 couples one end of the top wall 106 to one of the opposed pair of side walls 108.

The locking mechanism 124 may include any suitable mechanical locking mechanism known to those skilled in the art and guided by the teachings provided herein. In one or more examples, the locking mechanism 124 includes a male portion forming a first part the complimentary locking mechanism and a female portion forming a second part of the complimentary locking mechanism.

In one or more examples, the locking mechanism 124 includes a locking tab 126 (e.g., a male portion) and a corresponding locking slot 128 (e.g., a female portion). The locking tab 126 is received by and is secured within the locking slot 128. In one or more examples, as illustrated in FIGS. 3 and 4, the locking tab 126 associated with the top wall 106 and the locking slot 128 is associated with one of the side walls 108 (e.g., the second side wall 118 or the fourth side wall 122). Alternatively, in one or more examples, the locking slot 128 is associated with the top wall 106 and the locking tab 126 is associated with one of the side walls 108 (e.g., the second side wall 118 or the fourth side wall 122).

In the illustrated examples, the carton 100 includes the opposed pair of locking mechanisms 124. As an example, the top wall 106 includes an opposed pair of locking tabs 126 and each one of the first opposed pair of side walls 108 (e.g., the second side wall 118 or the fourth side wall 122) includes the locking slot 128. As another example, the top wall 106 includes an opposed pair of locking slots 128 and each one of the first opposed pair of side walls 108 (e.g., the second side wall 118 or the fourth side wall 122) includes the locking tab 126. As another example, the top wall 106 includes the locking tab 126 and an opposed locking slot 128, one of the first opposed pair of side walls 108 (e.g., the second side wall 118) includes the locking slot 128 corresponding to the locking tab 126 of the top wall 106, and the other one of the first opposed pair of side walls 108 (e.g., the fourth side wall 122) includes the locking tab 126 corresponding to the locking slot 128 of the top wall 106.

The top wall 106 and, thus, the handle 112 may have a double-walled or two-layered construction. In one or more examples, the top wall 106 includes, or is formed by, a first handle panel 136 and a second handle panel 138 that overlap each other. The first handle panel 136 and the second handle panel 138 are releasably coupled to at least one of the side walls 108, such as to the first opposed pair of side walls 108 by the locking mechanism 124. The top wall 106 having a double-layered construction formed by the first and second handle panels 136 and 138 provide additional reinforcement and structural integrity to the carton 100.

In one or more examples, the carton 100 includes at least one opening 208 formed through at least one of the side walls 108. For example, the opening 208 may be formed through one or more of the first side wall 116, the second side wall 118, the third side wall 120 and the fourth side wall 122. The opening 208 may have any suitable shape and dimension. The opening 208 provides visual access to the internal volume 110 of the carton 100 and, thus, the product contained within the carton 100. The opening 208 also facilitates air circulation through the internal volume 110 of the carton 100, which may be beneficial for keeping the product fresh.

Referring now to FIGS. 6-11, which schematically illustrate examples of the carton 100. In one or more examples, the carton 100 includes a plurality of panels 134 that form the internal volume 110, the handle 112 and the planar surface 114 of the carton 100. Generally, the plurality of panels 134 form the walls (FIGS. 3-5) of the carton 100.

In one or more examples, the plurality of panels 134 includes a first side panel 140. When constructed, the first side panel 140 may form the first side wall 116 (FIGS. 3-5). The plurality of panels 134 includes a second side panel 142 that is foldably (e.g., hingedly or movably) connected to the first side panel 140. When constructed, the second side panel 140 may form the second side wall 118 (FIGS. 3-5). The plurality of panels 134 includes a third side panel 144 that is foldably connected to the second side panel 142. When constructed, the third side panel 144 may form the third side wall 120 (FIGS. 3-5). The plurality of panels 134 includes a fourth side panel 146 that is foldably connected to the third side panel 144. When constructed, the fourth side panel 146 may form the fourth side wall 122 (FIGS. 3-5). The plurality of panels 134 includes the first handle panel 136 that is foldably connected to the first side panel 140 and that is releasably coupled to the second side panel 142 and the fourth side panel 146. The plurality of panels 134 includes the second handle panel 138 that is foldably connected to the third side panel 144 and releasably coupled to the second side panel 142 and the fourth side panel 146. When constructed, the first handle panel 136 and the second handle panel 138 form the top wall 106 (FIGS. 3-5) and the handle 112 of the carton 100 and, thus, form at least a portion of the planar surface 114 of the carton 100.

In one or more examples, the first handle panel 136 overlaps at least a portion of the second handle panel 138. In one or more examples, the first handle panel 136 overlaps an entirety of the second handle panel 138. In one or more examples, the first handle-panel 136 and the second handle panel 138 have substantially identical shapes such that when overlapped a portion of the first and second handle panels 136 and 138 form the handle 112.

In one or more examples, the locking mechanism 124 couples the first handle panel 136 and the second handle panel 138 to the second side panel 142 and the fourth side panel 146. In one or more examples, the first handle panel 136 and the second handle panel 138 extend between and interlock with the second handle panel 138 to the second side panel 142 and the fourth side panel 146, such that the first handle panel 136 and the second handle panel 138 provide, or serve as, a retaining strap that holds the carton 100 in the constructed and closed configuration.

As illustrated in FIGS. 6-8 and 12, in one or more examples, the locking mechanism 124 includes a handle-locking tab 148 and a wall-locking slot 150. The handle-locking tab 148 projects from each end 130 of each one of the first handle panel 136 and the second handle panel 138. The wall-locking slot 150 is formed through each one of the second side panel 142 and the fourth side panel 146. When the carton 100 is constructed, the handle-locking tab 148 is received by the wall-locking slot 150 and engages a corresponding one of the second side panel 142 and the fourth side panel 146. Mating engagement of the handle-locking tab 148 and the wall-locking slot 150 locks the first handle panel 136 and the second handle panel 138 to the second side panel 142 and the fourth side panel 146.

Figure 12:
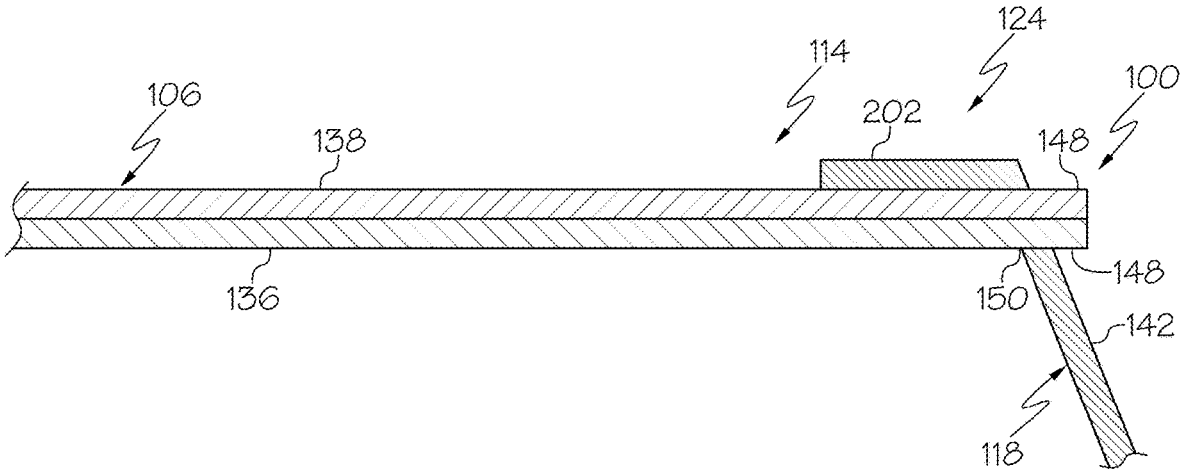
FIG. 12 is a schematic, side view of a portion of an example of the carton, depicting an example of a locking mechanism of the carton.

As illustrated in FIG. 12, in one or more examples, a portion of an end 132 of the second side panel 142 and the fourth side panel 146 extends beyond the handle 112 and is foldable to form a portion of the planar surface 114.

As illustrated in FIGS. 9-11, 13 and 14, in one or more examples, the locking mechanism 124 includes a wall-locking tab 152 and a handle-locking slot 154. The wall-locking tab 152 projects from the end 132 of each one of the second side panel 142 and the fourth side panel 146. The handle-locking slot 154 is formed through each end 130 of each one of the first handle panel 136 and the second handle panel 138. When the carton 100 is constructed, the wall-locking tab 152 is received by the handle-locking slot 154 and engages the handle 112. Mating engagement of the wall-locking tab 152 and the handle-locking slot 154 locks the first handle panel 136 and the second handle panel 138 to the second side panel 142 and the fourth side panel 146.

Figure 13:
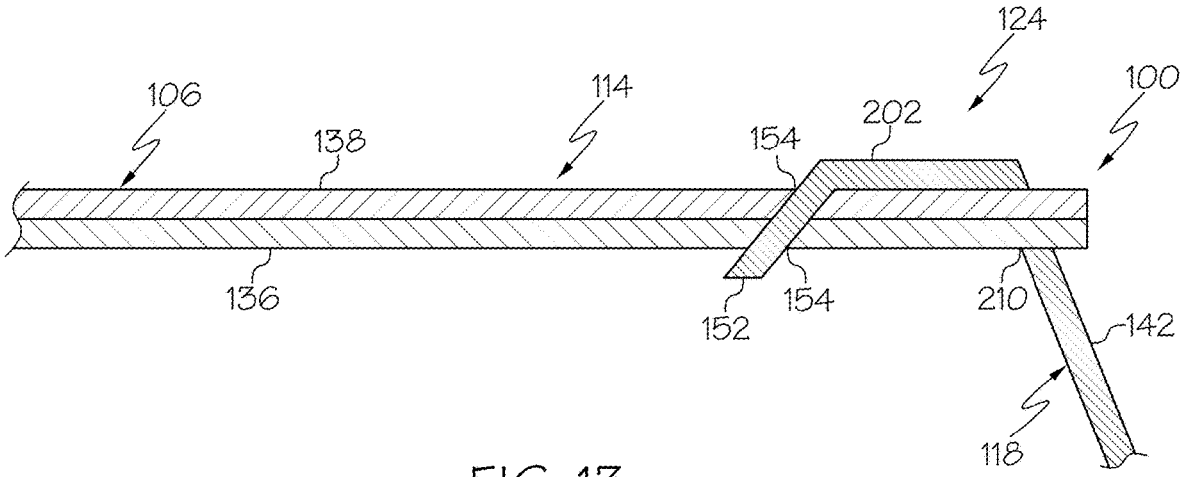
FIG. 13 is a schematic, side view of a portion of an example of the carton, depicting another example of the locking mechanism of the carton.
Figure 14:
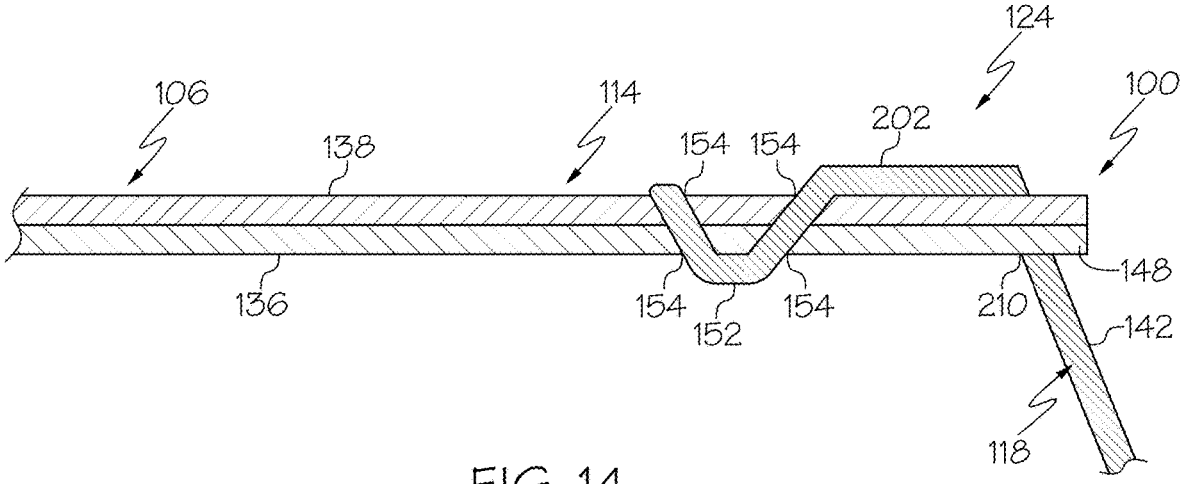
FIG. 14 is a schematic, side view of a portion of an example of the carton, depicting another example of the locking mechanism of the carton.

As illustrated in FIGS. 13 and 14, in one or more examples, a portion of the end 132 of each one of the second side panel 142 and the fourth side panel 146 forms a portion of the planar surface 114.

Referring again to FIGS. 6-11, in one or more examples, the carton 100 includes at least one opening 208 formed through at least one of the plurality of panels 134. In one or more examples, as illustrated in FIGS. 9-11, 13 and 14, each one of the second side panel 142 and the fourth side panel 146 includes an opening 210 located proximate to the end 132 of the respective one of the second side panel 142 and the fourth side panel 146. The opening 210 permits the ends 130 of the first handle panel 136 and the second handle panel 138 to extend through the respective second side panel 142 and the fourth side panel 146 when the first and second handle panels 136 and 138 are coupled to the second and fourth side panels 142 and 146 by the locking mechanism 124.

Referring now to FIGS. 15-18, the disclosure is also directed to a blank of sheet material, generally referred to herein as "blank" 102. The blank 102 is used to form (e.g., make, erect or otherwise construct) the carton 100. As an example, the carton 100 illustrated in FIGS. 3-8 and 12 maybe formed from the blank 102 illustrated in FIGS. 15 and 18. As another example, the carton 100 illustrated in FIGS. 9-11 and 13 may be formed from the blank 102 illustrated in FIG. 16. As another example, the carton 100 illustrated in FIG. 14 may be formed from the blank 102 illustrated in FIG. 17.

The blank 102 may be made of a sheet of suitable stock material. The blank 102 may be cut (e.g., die cut) from the sheet of stock material. Suitable stock material includes all manner of foldable sheet material. In one or more examples, the stock material is a cellulosic material, such as paperboard (e.g., solid bleached sulfate paperboard), cardboard or other heavy-duty paper-based material. In one or more examples, the stock material is polymeric material, such as plastic board (e.g., plastic cardboard) or sheet plastic. In one or more examples, the stock material is made of corrugated board (e.g., cellulosic or polymeric), such as corrugated board that includes two liner sheets and an inner fluted corrugated material sandwiched between and coupled to the liner sheets.

The blank 102 includes a series of panels connected one to the next by respective fold lines. Any one of the fold lines and/or hinge lines, described herein, may include any suitable predefined or preformed line of weakening and/or line of separation known to those skilled in the art and guided by the teachings herein provided, such as a crease, a score, a perforation, or the like. Generally, the fold lines transform the blank 102 into a plurality of separate but integrals panels, flaps, tabs and the like.

For clarity, it should be recognized that a first surface of the blank 102 is exposed (e.g., projecting towards the viewer) and is shown in FIGS. 15-18. For example, the first surface of the blank 102 may become an interior surface 156 of the carton 100 (FIGS. 3 and 4). The blank 102 also includes a corresponding second surface (e.g., underside) that is not seen until the carton 100 is formed from the blank 102. For example, the second surface of the blank 102 may become an exterior surface 158 of the carton 100 (FIGS. 3 and 4).

In one or more examples, the second surface of the blank 102, forming the exterior surface 158 of the carton 100, is coated (e.g., includes an exterior surface coating). The exterior surface coating may be a waterproof coating, a protective coating, an aesthetic coating and the like. In one or more examples, at least a portion of the second surface of the blank 102, forming the exterior surface 158 of the carton 100, is printed with various product information about the product. For example, the exterior surface 158 of the carton 100 may include branding or other product identification that is easily viewable by the consumer when the carton 100 is displayed.

In one or more examples, the first surface of the blank 102, forming the interior surface 156 of the carton 100, is coated (e.g., includes an interior surface coating). The interior surface coating may be a waterproof coating, a protective coating, an aesthetic coating and the like. For example, the interior surface 156 of the carton 100 may be coted to resist liquid or moisture from the product from weakening or damaging the carton 100.

In one or more examples, the blank 102 includes the first side panel 140, the second side panel 142, the third side panel 144, the fourth side panel 146, the first handle panel 136 and the second handle panel 138. In one or more examples, the first side panel 140 forms the first side wall 116 of the carton 100 when the carton 100 is formed from the blank 102. In one or more examples, the second side panel 142 forms the second side wall 118 of the carton 100 when the carton 100 is formed from the blank 102. In one or more examples, the third side panel 144 forms the third side wall 120 of the carton 100 when the carton 100 is formed from the blank 102. In one or more examples, the fourth side panel 146 forms the fourth side wall 122 of the carton 100 when the carton 100 is formed from the blank 102. In one or more examples, the first handle panel 136 and the second handle panel 138, collectively, form the top wall 106 and the handle 112 of the carton 100 when the carton 100 is formed from the blank 102.

Each one of the side panels 140, 142, 144 and 146 may have any suitable two-dimensional shape and/or any desired dimensions. In the illustrated examples, the each one of the side panels 140, 142, 144 and 146 have an approximately rectangular shape. As such, when the carton 100 is formed from the blank 102, the side walls 116, 118, 120 and 122 of the carton 100 may have any suitable or desired shape, such as an approximately rectangular shape.

In one or more examples, the first side panel 140, the second side panel 142, the third side panel 144 and the fourth side panel 146 are connected in linear series along a longitudinal axis of the blank 102. The second side panel 142 extends from and is foldably connected to the first side panel 140 along a fold line 160 (e.g., a first side panel fold line). The fold line 160 extends laterally and separates the second side panel 142 from the first side panel 140. The third side panel 144 extends from and is foldably connected to the second side panel 142 along a fold line 162 (e.g., a second side panel fold line), opposite the first side panel 140. The fold line 162 extends laterally, approximately parallel to the fold line 160, and separates the third side panel 144 from the second side panel 142. The fourth side panel 146 extends from and is foldably connected to the third side panel 144 along a fold line 164 (e.g., a third side panel fold line), opposite the second side panel 142. The fold line 164 extends laterally, approximately parallel to the fold line 162, and separates the fourth side panel 146 from the third side panel 144.

The second side panel 142 is hingedly movable (e.g., foldable) about the fold line 160 relative to the first side panel 140 such that it can move from the orientation shown in a flat configuration (e.g., as shown FIGS. 15-18) to an orientation shown in a constructed configuration (e.g., as shown in FIGS. 3-11). The third side panel 144 is hingedly movable about the fold line 162 relative to the second side panel 142 such that it can move from the orientation shown in a flat configuration (e.g., as shown FIGS. 15-18) to an orientation shown in a constructed configuration (e.g., as shown in FIGS. 3-11). The fourth side panel 146 is hingedly movable about the fold line 164 relative to the third side panel 144 such that it can move from the orientation shown in a flat configuration (e.g., as shown FIGS. 15-18) to an orientation shown in a constructed configuration (e.g., as shown in FIGS. 3-11).

In one or more examples, the blank 102 includes at least one opening 208 formed through at least one of the plurality of panels 134. The opening 208 may be formed (e.g., cut out) during formation of the blank 102. In one or more examples, the opening 208 may interrupt a fold line, thereby enabling the blank 102 to fold more easily during erection of the carton 100.

In one or more examples, one or more of the side panels 140, 142, 144 and 146 may include a lower portion 192 and an upper portion 194. As an example, the lower portion 192 of each one of the side panels 140, 142, 144 and 146 is foldably connected to the lower portion 192 of an adjacent one of the side panels 140, 142, 144 and 146 along a respective fold line 160, 162 and 164. The upper portion 194 extends from and is foldably connected to the lower portion 192 along a fold line 196. The fold line 196 extends longitudinally, approximately perpendicular to a respective fold line 160, 162 and 164, and separates the upper portion 194 from the lower portion 192.

The upper portion 194 is hingedly movable (e.g., foldable) about the fold line 196 relative to the lower portion 192 such that it can move from the orientation shown in a flat configuration (e.g., as shown FIGS. 15-18) to an orientation shown in a constructed configuration (e.g., as shown in FIGS. 3-11).

Each one of the lower portions 192 and the upper portion 194 of a respective side panel 140, 142, 144 and 146 may have any suitable two-dimensional shape and/or any desired dimensions. In the illustrated examples, the lower portion 192 has an approximately rectangular shape and the upper portion 194 has an approximately trapezoidal shape. As such, when the carton 100 is formed from the blank 102, one or more of the side walls 116, 118, 120 and 122 of the carton 100 may have a lower portion that has any suitable or desired shape, such as an approximately rectangular shape, and an upper portion that has any suitable or desired shape, such as an approximately trapezoidal shape.

As illustrated in FIGS. 3-11, in one or more examples, when the carton 100 is formed from the blank 102, the lower portion 192 of a respective side panel 140, 142, 144 and 146 is folded such that the lower portion of a respective side wall 116, 118, 120 and 122 is oriented approximately vertically (e.g., approximately perpendicular to the bottom wall 104). The upper portion 194 of the respective side panel 140, 142, 144 and 146 is folded at an oblique angle relative to the lower portion 192, such that the upper portion of the respective side wall 116, 118, 120 and 122 is oblique to the lower portion of the respective side wall 116, 118, 120 and 122.

Figure 15:
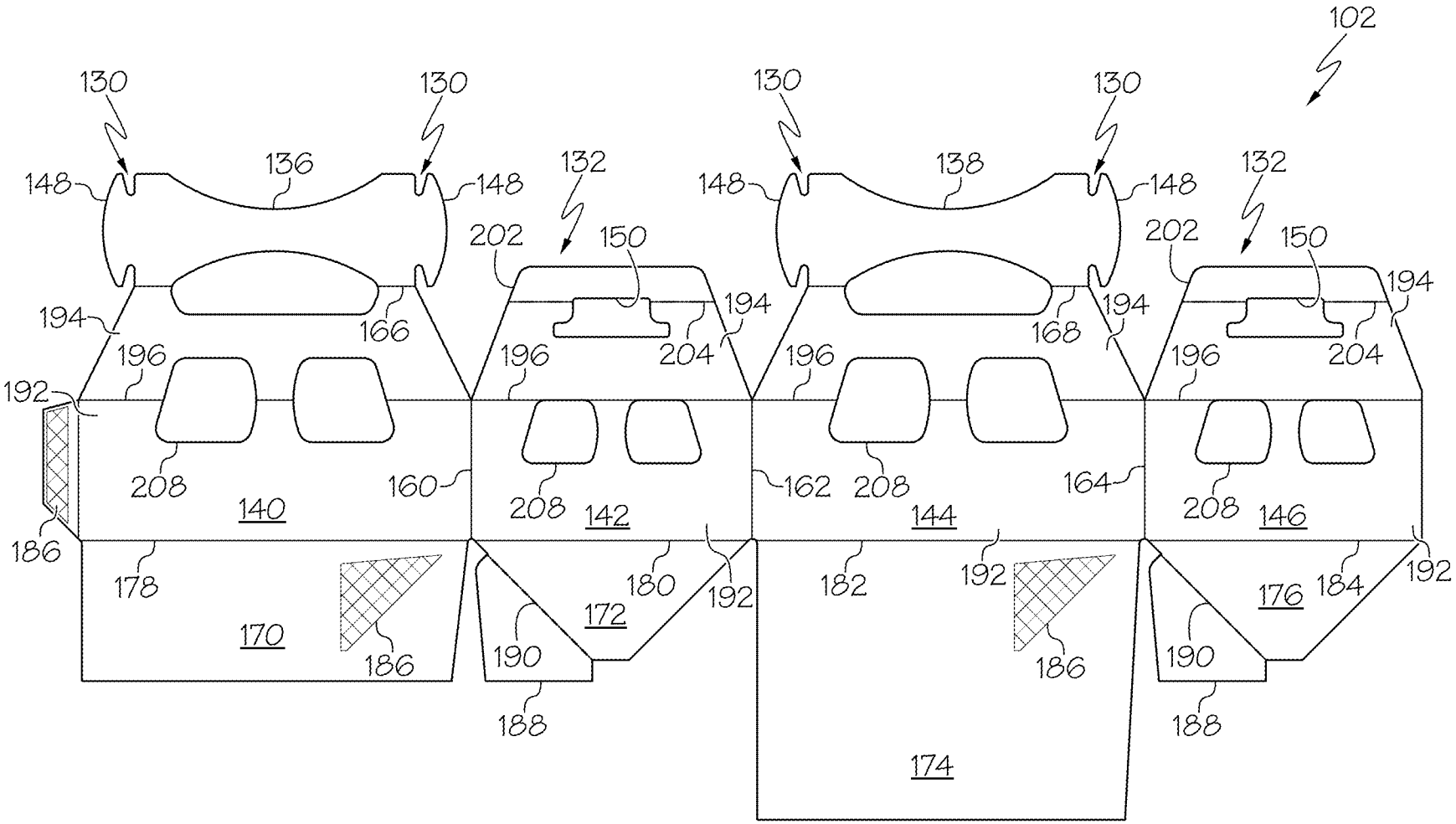
FIG. 15 is a schematic, plan view of an example of a blank used to form the carton.
Figure 16:
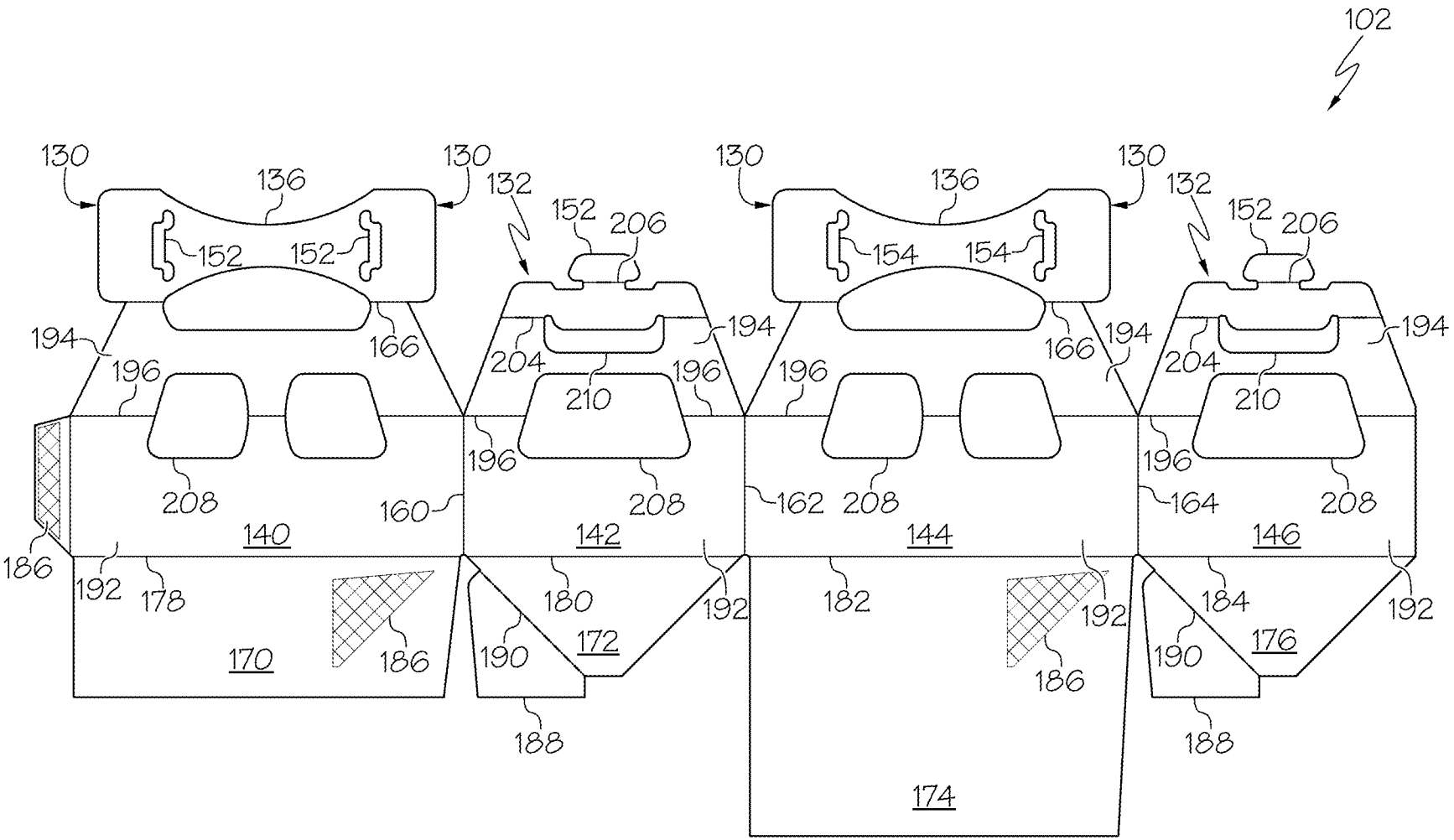
FIG. 16 is a schematic, plan view of another example of the blank used to form the carton.
Figure 17:
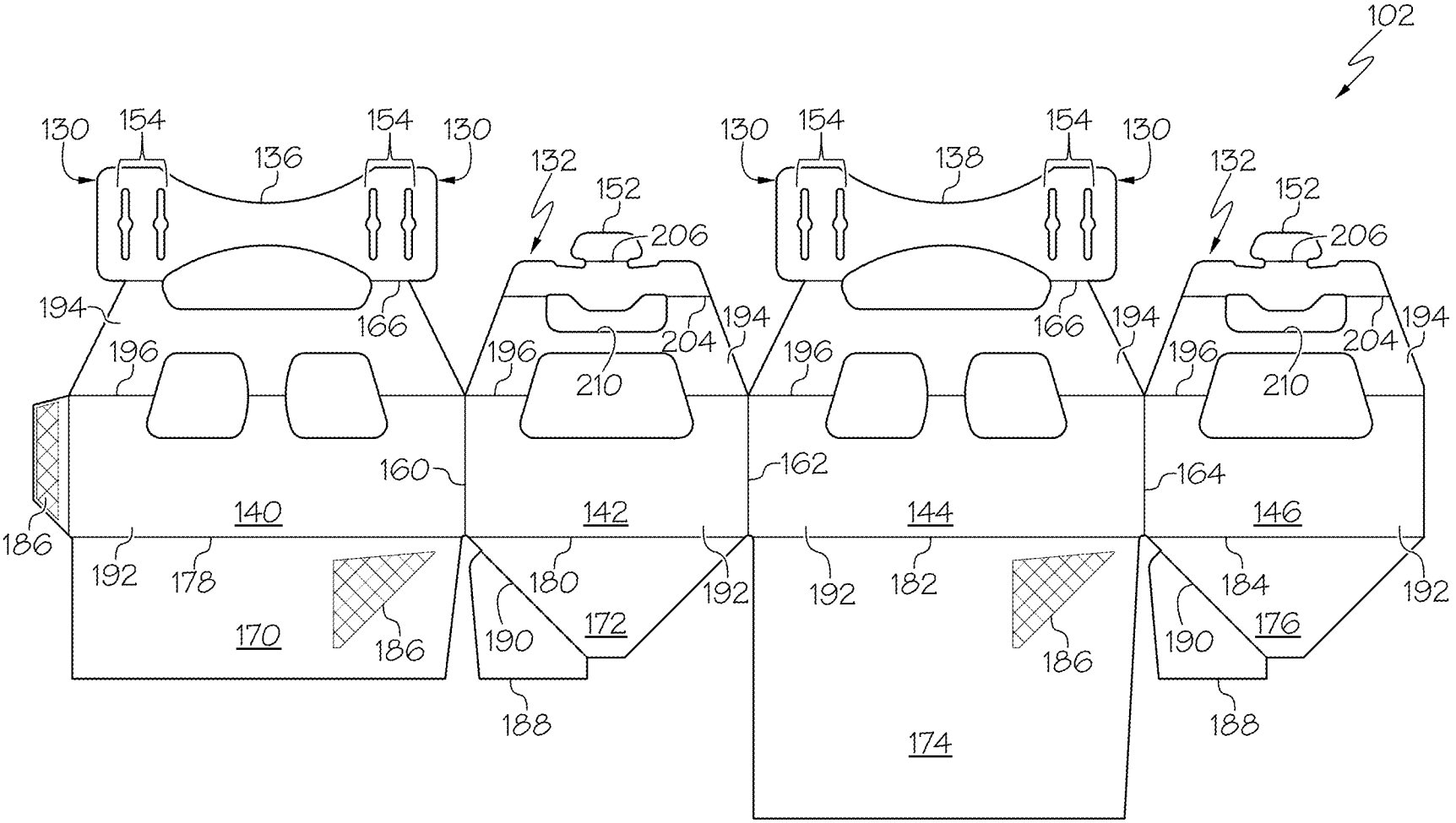
FIG. 17 is a schematic, plan view of another example of the blank used to form the carton.

Referring to FIGS. 15-17, in one or more examples, the upper portion of each one of the side panels 140, 142, 144 and 146 is free from (e.g., is not foldably connected) to the upper portion 194 of an adjacent one of the side panels 140, 142, 144 and 146. For example, a "V"-shaped cut out may be formed in the blank 102 between the upper portions 194 of an adjacent pair of the side panels 140, 142, 144 and 146 to separate each upper portion 194 from an adjacent upper portion 194.

Figure 18:
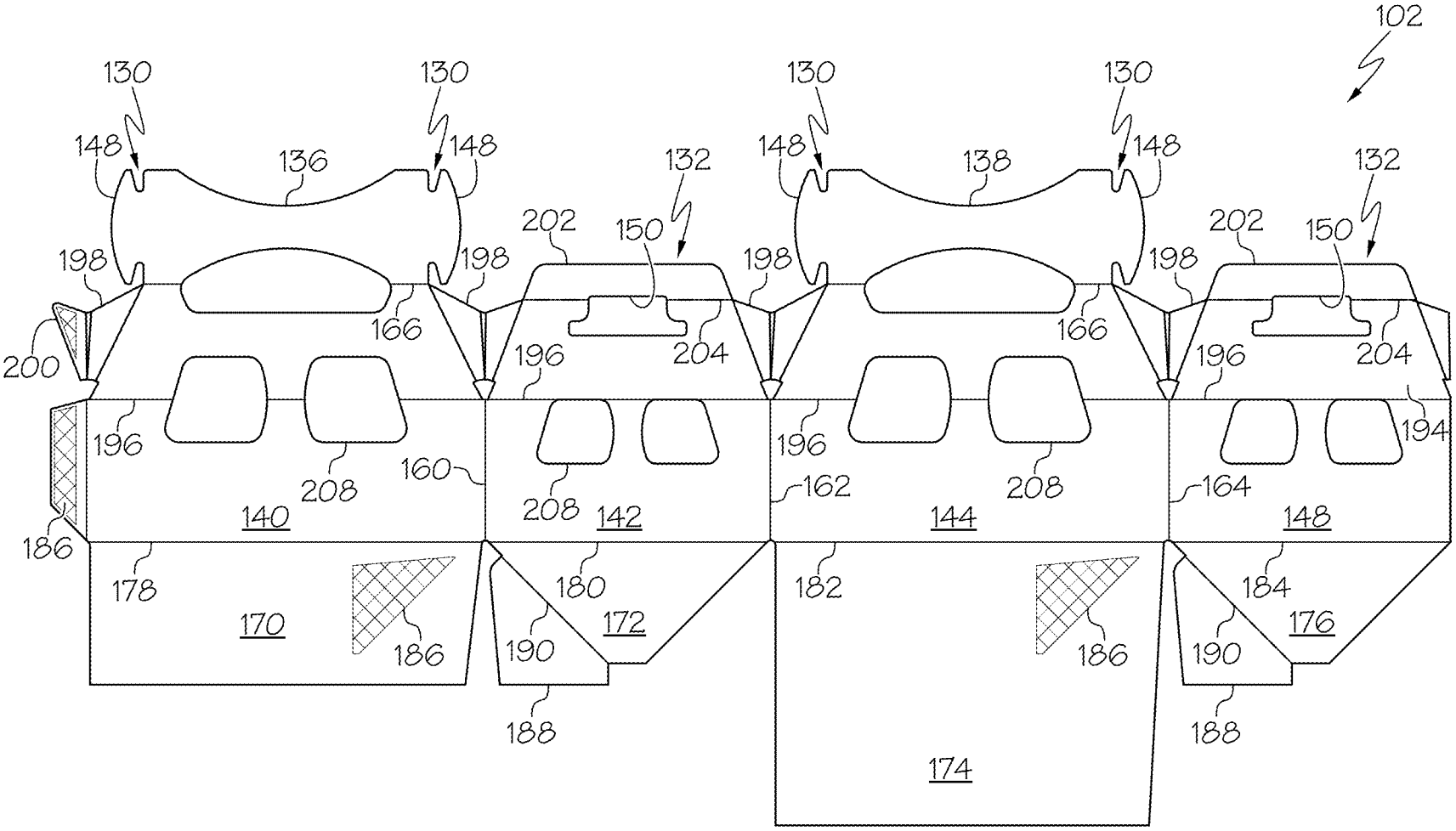
FIG. 18 is a schematic, plan view of another example of the blank used to form the carton.

Referring to FIG. 18, in one or more examples, the upper portion of each one of the side panels 140, 142, 144 and 146 is foldably connected to the upper portion 194 of an adjacent one of the side panels 140, 142, 144 and 146. As an example, the blank 102 may include a gusset panel 198 foldably connected to the upper portions 194 of respective side panels 140, 142, 144 and 146. The gusset panel 198 provides increased structural integrity to the carton 100, when the carton 100 is formed from the blank 102.

In one or more examples, the gusset panel 198 includes a pair of tuck-in panels. For example, a first tuck-in panel extends from and is foldably connected to the upper portion 194 of one of the side panels 140, 142, 144 and 146 along a fold line and a second tuck-in panel extends from and is foldably connected to the upper portion 194 of a directly adjacent one of the side panels 140, 142, 144 and 146 along a fold line. The first tuck-in panel and the second tuck-in panel are foldably connected along a fold line. When the carton 100 is formed from the blank 102, the gusset panel 198 folds inwardly (e.g., within the internal volume 110 of the carton 100), thereby holding the upper portion 194 of respective ones of the side panels 140, 142, 144 and 146 and, thus, the upper portion of respective ones of the side walls 116, 118, 120 and 122 in the constructed configuration (e.g., as shown in FIGS. 3-11).

In one or more examples, the first tuck-in panel and the second tuck-in panel of a respective gusset panel 198 that connects the upper portion 194 of the first side panel 140 and the upper portion 194 of the fourth side panel 146 are initially separated (e.g., when in the flat configuration of the blank 102) and are coupled (e.g., adhesively coupled) together when the carton 100 is formed from the blank 102. For example, a flap 200 may extend from and be foldably connected to the first tuck-in panel. The flap 200 may be coupled to the second tuck-in panel when the carton 100 is formed from the blank 102.

Referring again to FIGS. 15-18, the first handle panel 136 extends from and is foldably connected to the first side panel 140 along a fold line 166 (e.g., a first handle panel fold line). The fold line 166 extends longitudinally and separates the first handle panel 136 from the first side panel 140. The second handle panel 138 extends from and is foldably connected to the third side panel 144 along a fold line 168 (e.g., a second handle panel fold line). The fold line 168 extends longitudinally and separates the second handle panel 138 from the third side panel 144.

In one or more examples, the first handle panel 136 extends from and is foldably connected to the upper portion 194 of the first side panel 140 along the fold line 166. The fold line 166 extends longitudinally, approximately parallel to the fold line 196, and separates the first handle panel 136 from the upper portion 194 of the first side panel 140. The second handle panel 138 extends from and is foldably connected to the upper portion 194 of the third side panel 144 along the fold line 168. The fold line 168 extends longitudinally, approximately parallel to the fold line 196, and separates the second handle panel 138 from the upper portion 194 of the third side panel 144.

The first handle panel 136 is hingedly movable (e.g., foldable) about the fold line 166 relative to the first side panel 140 such that it can move from the orientation shown in a flat configuration (e.g., as shown FIGS. 15-18) to an orientation shown in a constructed configuration (e.g., as shown in FIGS. 3-11). The second handle panel 138 is hingedly movable (e.g., foldable) about the fold line 168 relative to the first side panel 140 such that it can move from the orientation shown in a flat configuration (e.g., as shown FIGS. 15-18) to an orientation shown in a constructed configuration (e.g., as shown in FIGS. 3-11).

In one or more examples, the blank 102 includes a cut out, or opening, formed between the first side panel 140 and the first handle panel 136 and a cut out, or opening, formed between the third side panel 144 and the second handle panel 138. For example, the cut out may be located along, or interrupt, respective fold lines 166 and 168. The cut out provides a contoured edge of one side of the respective first handle panel 136 and second handle panel 138, thereby forming the handle 112 and, thus, the handle portion of the top wall 106.

In one or more examples, the blank 102 includes at least one bottom panel that extends from and that is foldably connected to at least one of the side panels 140, 142, 144 and 146. The at least one bottom panel forms the bottom wall 104 of the carton 100 when the carton 100 is formed from the blank 102.

In the illustrated examples, the blank 102 includes a first bottom panel 170, a second bottom panel 172, a third bottom panel 174 and a fourth bottom panel 176. The first bottom panel 170 extends from and is foldably connected to the first side panel 140 along a fold line 178 (e.g., a first bottom panel fold line). The fold line 178 extends longitudinally, approximately parallel to the fold line 166 and approximately perpendicular to the fold line 160, and separates the first bottom panel 170 from the first side panel 140. The second bottom panel 172 extends from and is foldably connected to the second side panel 142 along a fold line 180 (e.g., a second bottom panel fold line). The eighth fold line 180 extends longitudinally, approximately colinear to the fold line 166 and approximately perpendicular to the fold line 160 and the fold line 162, and separates the second bottom panel 172 from the second side panel 142. The third bottom panel 174 extends from and is foldably connected to the third side panel 144 along a fold line 182 (e.g., a third bottom panel fold line). The fold line 182 extends longitudinally, approximately colinear to the fold line 180, approximately parallel to the fold line 168 and approximately perpendicular to the fold line 162 and the fold line 164, and separates the third bottom panel 174 from the third side panel 144. The fourth bottom panel 176 extends from and is foldably connected to the fourth side panel 146 along a fold line 184 (e.g., a fourth bottom panel fold line). The fold line 184 extends longitudinally, approximately colinear to the fold line 180 and approximately perpendicular to the fold line 164, and separates the fourth bottom panel 176 from the fourth side panel 146.

Each one of the bottom panels 170, 172, 174 and 176 is hingedly movable (e.g., foldable) about a respective fold line 178, 180, 182 and 184 relative to a respective side panel 140, 142, 144 and 146 such that it can move from the orientation shown in a flat configuration (e.g., as shown FIGS. 15-18) to an orientation shown in a constructed configuration (e.g., as shown in FIGS. 3-11).

In other examples, the blank 102 may include a different number (e.g., less than four) bottom panels and/or a different configuration of bottom panels. As such, the illustrated examples of the bottom panels that form the bottom wall 104 of the carton 100 should not been seen as a limiting factor.

Each one of the bottom panels 170, 172, 174 and 176 may have any suitable two-dimensional shape and/or any desired dimensions. In the illustrated examples, one or more of the bottom panels 170, 172, 174 and 176 have a rectangular shape or a trapezoidal shape. As such, when the carton 100 is formed from the blank 102, the bottom wall 104 of the carton 100 may have any suitable or desired shape, such as an approximately rectangular shape.

One or more of the bottom panels 170, 172, 174 and 176 may be coupled to another one of more of the bottom panels 170, 172, 174 and 176 by any suitable technique known to those skilled in the art and guided by the teachings provided herein. For example, one or more of the bottom panels 170, 172, 174 and 176 may be interlocked with each other, adhesively coupled to each other, taped to each other and combinations thereof.

In one or more examples, such as when an adhesive is used to couple the bottom panels 170, 172, 174 and 176 together, at least a portion of at least one of the bottom panels 170, 172, 174 and 176 may include a coating-free area 186 that facilitates the adhesive bond.

In one or more examples, one or more of the bottom panels 170, 172, 174 and 176 may include a flap 188 that extends from a respective one of the bottom panels 170, 172, 174 and 176. The flap 188 may facilitate coupling of a corresponding pair of the bottom panels 170, 172, 174 and 176. For example, the flap 188 of one of the bottom panels 170, 172, 174 and 176 may engage and be adhesively coupled to the coating-free area 186 of a corresponding one of the bottom panels 170, 172, 174 and 176 when the carton 100 is formed from the blank 102.

In one or more examples, the flap 188 may be foldably connected to a respective one of the bottom panels 170, 172, 174 and 176 along a fold line 190 (e.g., a flap fold line). The flap 188 is hingedly movable (e.g., foldable) about the fold line 190 relative to respective one of the bottom panels 170, 172, 174 and 176 such that it can move during construction of the carton 100 from the blank 102. In one or more examples, the fold line 190 may include intermittent cuts or perforations that enable the flap 188 to fold during construction more easily.

The blank 102 includes at least one locking mechanism 124 for interlocking the first handle panel 136 and the second handle panel 138 to the second side panel 142 and the fourth side panel 146 when the carton 100 is formed from the blank 102.

In one or more examples, the blank 102 includes a first portion (e.g., a male portion as illustrated in FIGS. 15 and 18 or a female portion as illustrated in FIGS. 16 and 17) of the locking mechanism 124 on each one of the first handle panel 136 and the second handle panel 138. The blank 102 includes a second portion (e.g., a female portion as illustrated in FIGS. 15 and 18 or a male portion illustrated in FIGS. 16 and 17) of the locking mechanism 124 on each one of the second side panel 142 and the fourth side panel 146. When the carton 100 is formed from the blank 102, the first portion of the locking mechanism 124 and the second portion of the locking mechanism 124 cooperate to couple the first handle panel 136 and the second handle panel 138 to the second side panel 142 and the fourth side panel 146. When the carton 100 is formed from the blank 102, the first handle panel 136 and the second handle panel 138 form the handle 112, the top wall 106 and the planar surface 114 of the carton 100.

Referring to FIGS. 15 and 18, in one or more examples, the first portion of the locking mechanism 124 includes a handle-locking tab 148. The handle-locking tab 148 is an example of the locking tab 126 (e.g., shown in FIGS. 3-5). The handle-locking tab 148 projects from each end 130 of each one of the first handle panel 136 and the second handle panel 138. The second portion of the locking mechanism 124 includes a wall-locking slot 150. The wall-locking slot 150 is an example of the locking slot 128 (e.g., shown in FIGS. 3-5). The wall-locking slot 150 is formed through each one of the second side panel 142 and the fourth side panel 146. The handle-locking tab 148 is configured to be received by the wall-locking slot 150 and to engage a corresponding one of the second side panel 142 and the fourth side panel 146 to couple the first handle panel 136 and the second handle panel 138 and the second side panel 142 and the fourth side panel 146 together when the carton 100 is formed from the blank 102.

Generally, the wall-locking slot 150 is located proximate (e.g., at or near) the end 132 of a respective one of the second side panel 142 and the fourth side panel 146. In one or more examples, the wall-locking slot 150 is spaced away from an end edge of the respective one of the second side panel 142 and the fourth side panel 146 such that a portion of the end 132 of each one of the second side panel 142 and the fourth side panel 146 extends beyond overlapped first handle panel 136 and second handle panel 138 when the carton 100 is formed from the blank 102 (e.g., as shown in FIGS. 6-8 and 12). As such, a portion of each end 132 of the second side wall 118 and the fourth side wall 122 extends beyond the top wall 106 (e.g., as shown in FIGS. 3-5).

In one or more examples, each one of the second side panel 142 and the fourth side panel 146 includes a hinge panel 202 located at the end 132 of a respective one of the second side panel 142 and the fourth side panel 146. The hinge panel 202 extends from and is foldably connected to the respective one of the second side panel 142 and the fourth side panel 146 along a fold line 204 (e.g., a hinge panel fold line). For example, the hinge panel 202 extends from and is foldably connected to the upper portion 194 of the respective one of the second side panel 142 and the fourth side panel 146 along the fold line 204. The fold line 204 extends longitudinally, approximately parallel to a respective fold line 196, and separates the hinge panel 202 from the respective one of the second side panel 142 and the fourth side panel 146.

The hinge panel 202 is hingedly movable (e.g., foldable) about the fold line 204 relative to the respective one of the second side panel 142 and the fourth side panel 146 such that it can move into an approximately coplanar relationship with the first handle panel 136 and the second handle panel 138 and, thus, form a portion of the planar surface 114 when a second carton 100 is stacked on the carton 100.

In one or more examples, the fold line 204 may include intermittent cuts or perforations that enable the hinge panel 202 to fold during stacking more easily. In one or more examples, the wall-locking slot 150 interrupts, or is located along, the fold line 204, thereby enabling the hinge panel 202 to fold during stacking more easily and positioning the hinge panel 202 directly above the overlapped first handle panel 136 and second handle panel 138.

Referring to FIGS. 16 and 17, in one or more examples, the first portion of the locking mechanism 124 includes a handle-locking slot 154. The handle-locking slot 154 is an example of the locking slot 128 (e.g., shown in FIGS. 3-5). The handle-locking slot 154 is formed through each end 130 each one of the first handle panel 136 and the second handle panel 138. The second portion of the locking mechanism 124 includes a wall-locking tab 152. The wall-locking tab 152 is an example of the locking tab 126 (e.g., shown in FIGS. 3-5). The wall-locking tab 152 projects from the end 132 (e.g., the end edge) of each one of the second side panel 142 and the fourth side panel 146. The wall-locking tab 152 is configured to be received by the handle-locking slot 154 and to engage the handle 112 to couple the first handle panel 136 and the second handle panel 138 and the second side panel 142 and the fourth side panel 146 together when the carton 100 is formed from the blank 102.

Generally, the handle-locking slot 154 is located proximate (e.g., at or near) each opposing end 130 of a respective one of the first handle panel 136 and the second handle panel 138. In one or more examples, the handle-locking slot 154 is spaced away from each opposing end edge of the respective one of the first handle panel 136 and the second handle panel 138.

In one or more examples, the wall-locking tab 152 extends from and is foldably connected to the hinge panel 202 of a respective one of the second side panel 142 and the fourth side panel 146 along a fold line 206 (e.g., a locking tab fold line). The fold line 206 extends longitudinally, approximately parallel to a respective fold line 204. The wall-locking tab 152 is hingedly movable (e.g., foldable) about the fold line 206 relative to the hinge panel 202 such that it can move during insertion into a corresponding handle-locking slot 154 when the carton 100 is formed from the blank 102. In one or more examples, the fold line 206 may include intermittent cuts or perforations that enable the hinge panel 202 to fold during stacking more easily.

In one or more examples, the hinge panel 202 is hingedly movable (e.g., foldable) about the fold line 204 relative to the respective one of the second side panel 142 and the fourth side panel 146 such that it can move into an approximately coplanar relationship with the first handle panel 136 and the second handle panel 138 and, thus, form a portion of the planar surface 114 when the wall-locking tab 152 is received by the handle-locking slot 154 (e.g., as shown in FIG. 13).

In one or more examples, the openings 210 interrupts, or is located along, the fold line 204, thereby enabling the hinge panel 202 to fold during insertion of the wall-locking tab 152 within the handle-locking slot 154. The opening 210 also permits the ends 130 of each one of the first and second handle panels 136 and 138 to extend through a respective one of the second and fourth side panels 142 and 146 during insertion of the wall-locking tab 152 within the handle-locking slot 154 (e.g., as shown in FIGS. 13 and 14).

Referring to FIG. 17, in one or more examples, the first portion of the locking mechanism 124 includes a pair of handle-locking slots 154. The pair of handle-locking slots 154 is an example of the locking slot 128 (e.g., shown in FIGS. 3-5). The pair of handle-locking slots 154 is formed through each end 130 each one of the first handle panel 136 and the second handle panel 138.

In one or more examples, the pair of handle-locking slots 154 is spaced apart from and is parallel to each other. When the carton 100 is formed from the blank 102, the wall-locking tab 152 is inserted through a first one of the pair of handle-locking slots 154 from a first direction and is then inserted through a second one of the pair of handle-locking slots 154 from a second direction, opposite the first direction, such that the wall-locking tab 152 loops, or winds, through the pair of handle-locking slots 154 (e.g., as shown in FIG. 14), thereby providing a double lock. This double-locking arrangement between the wall-locking tab 152 and the pair of handle-locking slots 154 provides a more secure interlock between the first and second handle panels 136 and 138 and the second and fourth side panels 142 and 146.

Generally, the locking tab 126 (e.g., the handle-locking tab 148 or the wall-locking tab 152) and the locking slot 128 (e.g., the handle-locking slot 154 or the wall-locking slot 150) have complementary and mating shapes that enable the locking tab 126 to be pass through the locking slot 128 in one direction but impedes passage of the locking tab 126 through the locking slot 128 in the opposite direction. As an example, the locking tab 126 may have a truncated arrowhead shape.

As illustrated in FIGS. 15 and 18, in one or more examples, the handle-locking tab 148 may include a main portion, connected to and extending from the end 130 of the respective first handle panel 136 and second handle panel 138, and an opposed pair of anchoring portions, connected to and extending outwardly from the main portion. A notch or recess may be formed between each one of the anchoring portions and the end edge of the respective first handle panel 136 and second handle panel 138. When the handle-locking tab 148 is received by the wall-locking slot 150, a portion of a respective one of the second side panel 142 and the fourth side panel 146 may be located within the notch, thereby holding the handle-locking tab 148 within the wall-locking slot 150 by an interference fit.

In one or more examples, the anchoring portions of the handle-locking tab 148 may be flexed or bent relative to the main portion during insertion within the wall-locking slot 150. Once the handle-locking tab 148 has cleared an edge of the wall-locking slot 150, the anchoring portions may spring back into a more planar condition relative to the main portion (e.g., flatten out due to the natural resilience of the stock material of the blank 102) such that an edge of the anchoring portion abuts an inner surface of a respective one of the second side panel 142 and the fourth side panel 146 when tension is applied in opposition to the locking direction.

In one or more examples, the wall-locking slot 150 may have a first portion and a second portion, as illustrated in FIGS. 15 and 18. The first portion is suitably sized (e.g., larger than the handle-locking tab 148) to enable insertion of the handle-locking tab 148 through the first portion. The second portion is suitably sized (e.g., smaller than the handle-locking tab 148) to impede removal of the handle-locking tab 148 through the second portion.

As illustrated in FIGS. 16 and 17, in one or more examples, the wall-locking tab 152 may include a main portion, connected to and extending from the end 132 of the respective second side panel 142 and fourth side panel 146, and an opposed pair of anchoring portions, connected to and extending outwardly from the main portion. A notch or recess may be formed between each one of the anchoring portions and the end edge of the respective second side panel 142 and fourth side panel 146. When the wall-locking tab 152 is received by the handle-locking slot 154, a portion of the first handle panel 136 and the second handle panel 138 may be located within the notch, thereby holding the wall-locking tab 152 within the handle-locking slot 154 by an interference fit.

In one or more examples, the anchoring portions of the wall-locking tab 152 may be flexed or bent relative to the main portion during insertion within the handle-locking slot 154. Once the wall-locking tab 152 has cleared an edge of the handle-locking slot 154, the anchoring portions may spring back into a more planar condition relative to the main portion (e.g., flatten out due to the natural resilience of the stock material of the blank 102) such that an edge of the anchoring portion abuts an interior surface of the underling one of the overlapping first and second handle panels 136 and 138 when tension is applied in opposition to the locking direction.

In one or more examples, the handle-locking slot 154 may be approximately linear (e.g., as shown in FIG. 17). In one or more examples, the handle-locking slot 154 may be nonlinear (e.g., as shown in FIG. 16), thereby being configured to enable insertion of the wall-locking tab 152 when the anchoring portion is bent but not requiring as much spring back for the edge of the anchoring portion to abuts the interior surface of the underling one of the overlapping first and second handle panels 136 and 138.

The present disclosure is further directed to a method of forming the carton 100 from the blank 102. The method may include a series of sequential folding operations. The folding process is not limited to any particular folding process and may be altered according to particular manufacturing requirements.

In one or more examples, the method includes a step of providing the blank 102 that includes the plurality of panels 134. The method includes a step of manipulating the blank 102 such that the plurality of panels 134 form the bottom wall 104, the top wall 106, the plurality of side walls 108, the handle 112 and the planar surface 114 of the carton 100. The top wall 106 is releasably coupled to an opposed pair of the plurality of side walls 108. The handle 112 is formed by at least a portion of the top wall 106. The handle 112 and the top wall 106 form the planar surface 114 of the carton 100.

In one or more examples, the carton 100 may be erected and formed around the product. In one or more examples, the carton 100 may be partially erected and filled with the product. The erecting and filling process may be performed manually or using a machine in an automated process or a combination thereof.

The present disclosure is additionally directed to a method of packaging product within the carton 100. The carton 100 includes the bottom wall 104, the plurality of side walls 108, the top wall 106, the handle 112 formed by at least a portion of the top wall 106 and the planar surface 114 at least partially formed by the handle 112 and the top wall 106. In one or more examples, the method includes a step of erecting the carton 100 such that one of the side walls 108 is uncoupled from the top wall 106. The method includes a step of loading product into the internal volume 110 of the carton 100. The method includes a step of further erecting the carton 100 such that the one of the side walls 108 is coupled to the top wall 106. In one or more examples, the carton 100 is a first one of a plurality of cartons 100. The method includes a step of stacking a second one of the plurality of cartons 100 on the planar surface 114 of the first one of the plurality of cartons 100 (e.g., as shown in FIG. 5).

The disclosed carton 100 provides a minimal-material solution, with comparable performance (e.g., integrity and market) to a conventional product container. The various examples of the disclosed carton 100 formed from the blank 102 include the handle 112, thereby enabling the carton 100 to serve as a product carrier. The handle 112 essentially forms the top wall 106 of the carton 100 and has a portion of the locking mechanism 124 (either male or female) on lateral end portions thereof that engages with a corresponding portion of the locking mechanism 124 located on an upper portion of each side wall 108, respectively, forming ends of the carton 100. As such, the handle 112 extends between and engages the side walls 108 (e.g., side panels) of the carton 100, rather than being engaged with a top panel of the carton (e.g., like conventional product packaging), thereby providing the carton 100 with increased structural integrity. Additionally, the handle 112 and, thus, the top wall 106 have a double-layered construction formed by the two substantially identical handle panels 136 and 138, which provide additional reinforcement and structural integrity to the carton 100. Further, the configuration of the side walls 108 (e.g., the side panels) and the top wall 106 and the handle 112 (e.g., the handle panels 136, 138) provide the planar surface 114 upon which a second carton may be stacked, thereby enabling stacking while providing a handled carton 100.

For the purpose of the present disclosure, the terms "interior," "exterior," "lower," "upper," "bottom," "top," "front," "rear," "side," "end" and similar terms or other forms of such terms are relative and refer to an example of a spatial relationship between structures, elements, items, components or features or indicate orientations determined in relation to fully erect and upright cartons (e.g., as shown in FIGS. 3-11). As such, examples of the carton 100 and the blank 102, described herein and illustrated in the figures, are not intended to be limited by the specific relative terms used to describe any structure, element, item, component or feature of the carton 100 or the blank 102.

Examples of the disclosed carton 100 and blank 102 for making the same are described above in detail. The blank 102 and the carton 100 are not limited to the specific examples described herein, but rather, components, elements, and/or features of the blanks and/or the containers may be utilized independently and separately from other components, elements, and/or features described herein. For example, the blanks may also be used in combination with other type of product and is not limited to practice with only the articles as described and illustrated herein. Rather, the exemplary embodiment can be implemented and utilized in connection with many other applications.

Unless otherwise indicated, the terms "first," "second," "third," etc. are used herein merely as labels, and are not intended to impose ordinal, positional, or hierarchical requirements on the items to which these terms refer. Moreover, reference to, e.g., a "second" item does not require or preclude the existence of, e.g., a "first" or lower-numbered item, and/or, e.g., a "third" or higher-numbered item.

As used herein, the phrase "at least one of", when used with a list of items, means different combinations of one or more of the listed items may be used and only one of each item in the list may be needed. For example, "at least one of item A, item B, and item C" may include, without limitation, item A or item A and item B. This example also may include item A, item B, and item C, or item B and item C. In other examples, "at least one of" may be, for example, without limitation, two of item A, one of item B, and ten of item C; four of item B and seven of item C; and other suitable combinations.

For the purpose of this disclosure, the terms "coupled," "coupling," and similar terms refer to two or more elements that are joined, linked, fastened, attached, connected, put in communication, or otherwise associated with one another. In various examples, the elements may be associated directly or indirectly. As an example, element A may be directly associated with element B. As another example, element A may be indirectly associated with element B, for example, via another element C. It will be understood that not all associations among the various disclosed elements are necessarily represented. Accordingly, couplings other than those depicted in the figures may also exist.

As used herein, the term "substantially" refers to a condition that is essentially the stated condition that performs the desired function or achieves the desired result. As used herein, the term "approximately" refers to a condition that is close to the stated condition, but not exactly, the stated condition that still performs the desired function or achieves the desired result. However, use of the terms "substantially" and "approximately" do not exclude a condition that is exactly the stated condition.

Those skilled in the art will appreciate that not all elements described and illustrated in FIGS. 1-18 need be included in every example and not all elements described herein are necessarily depicted in each illustrative example. Unless otherwise explicitly stated, the schematic illustrations of the examples depicted in FIGS. 1-18 are not meant to imply structural limitations with respect to the illustrative example. Rather, although one illustrative structure is indicated, it is to be understood that the structure may be modified when appropriate. Additionally, modifications, additions and/or omissions may be made to the illustrated structure.

Further, references throughout the present specification to features, advantages, or similar language used herein do not imply that all of the features and advantages that may be realized with the examples disclosed herein should be, or are in, any single example. Rather, language referring to the features and advantages is understood to mean that a specific feature, advantage, or characteristic described in connection with an example is included in at least one example. Thus, discussion of features, advantages, and similar language used throughout the present disclosure may, but do not necessarily, refer to the same example.

The described features, advantages, and characteristics of one example may be combined in any suitable manner in one or more other examples. One skilled in the relevant art will recognize that the examples described herein may be practiced without one or more of the specific features or advantages of a particular example. In other instances, additional features and advantages may be recognized in certain examples that may not be present in all examples. Furthermore, although various examples of the carton 100 and the blank 102 for forming the carton 100 and methods have been shown and described, modifications may occur to those skilled in the art upon reading the specification. The present application includes such modifications and is limited only by the scope of the claims.

What is claimed is:

1. A carton for packaging product, the carton comprising:

a plurality of panels that form an internal volume, a handle and a planar surface of the carton, the plurality of panels comprising:

a first side panel;

a second side panel foldably connected to the first side panel;

a third side panel foldably connected to the second side panel;

a fourth side panel foldably connected to the third side panel;

a first handle panel foldably connected to the first side panel and releasably coupled to the second side panel and the fourth side panel; and a second handle panel foldably connected to the third side panel and releasably coupled to the second side panel and the fourth side panel, wherein an interior surface of the first handle panel overlaps at least a portion of an exterior surface of the second handle panel such that exterior surfaces of the first handle panel and the second handle panel face outward of the carton and such that the first handle panel and the second handle panel together form the handle and form at least a portion of the planar surface, and wherein a locking mechanism couples the first handle panel and the second handle panel to the second side panel and the fourth side panel respectively.

2. The carton of claim 1, wherein:

the locking mechanism comprises:

a handle-locking tab projecting from each end of each one of the first handle panel and the second handle panel; and a wall-locking slot formed through each one of the second side panel and the fourth side panel; and the handle-locking tab is received by the wall-locking slot and engages a corresponding one of the second side panel and the fourth side panel.

3. The carton of claim 2, wherein a portion of an end of the second side panel and the fourth side panel projects above the handle and is foldable to form a portion of the planar surface.

4. The carton of claim 1, wherein:

the locking mechanism comprises:

a wall-locking tab projecting from an end of each one of the second side panel and the fourth side panel; and a handle-locking slot formed through each end of each one of the first handle panel and the second handle panel; and the wall-locking tab is received by the handle-locking slot and engages the handle.

5. The carton of claim 4, wherein a portion of the end of each one of the second side panel and the fourth side panel forms a portion of the planar surface.

6. The carton of claim 1, further comprising at least one opening formed through at least one of the plurality of panels.

7. A blank for forming the carton of claim 1.

8. A blank for forming a carton, the blank comprising:

a first side panel;

a second side panel foldably connected to the first side panel;

a third side panel foldably connected to the second side panel;

a fourth side panel foldably connected to the third side panel;

a first handle panel foldably connected to the first side panel;

a second handle panel foldably connected to the third side panel;

a first portion of a locking mechanism on each one of the first handle panel and the second handle panel; and a second portion of the locking mechanism on each one of the second side panel and the fourth side panel, wherein, when the carton is formed from the blank:

an interior surface of the first handle panel overlaps at least a portion of an exterior surface of the second handle panel such that exterior surfaces of the first handle panel and the second handle panel face outward of the carton;

the first portion of the locking mechanism and the second portion of the locking mechanism cooperate to couple the first handle panel and the second handle panel to the second side panel and the fourth side panel; and the first handle panel and the second handle panel form a handle and at least a portion of a planar surface of the carton.

9. The blank of claim 8, wherein:

the first portion of the locking mechanism comprises a handle-locking tab projecting from each end of each one of the first handle panel and the second handle panel;

the second portion of the locking mechanism comprises a wall-locking slot formed through each one of the second side panel and the fourth side panel; and the handle-locking tab is configured to be received by the wall-locking slot and to engage a corresponding one of the second side panel and the fourth side panel.

10. The blank of claim 8, wherein:

the first portion of the locking mechanism comprises a handle-locking slot formed through each end portion of each one of the first handle panel and the second handle panel;

the second portion of the locking mechanism comprises a wall-locking tab projecting from an end of each one of the second side panel and the fourth side panel; and the wall-locking tab is configured to be received by the handle-locking slot and to engage the handle.

11. The blank of claim 8, further comprising at least one opening formed through at least one of the first side panel, the second side panel, the third side panel and the fourth side panel.

* * * * *